US005137803A

United States Patent [19]

Goda

[11] Patent Number: 5,137,803

[45] Date of Patent: Aug. 11, 1992

[54] SILVER HALIDE PHOTOGRAPHIC MATERIALS

[75] Inventor: Kensuke Goda, Kanagawa, Japan

[73] Assignee: Fuji Photo Film Co., Ltd., Ashigara, Japan

[21] Appl. No.: 454,065

[22] Filed: Dec. 20, 1989

[30] Foreign Application Priority Data

Dec. 22, 1988 [JP] Japan ..... 63-324420

[51] Int. Cl.[5] ..... G03C 1/015

[52] U.S. Cl. ..... 430/569; 430/567; 430/600; 430/613

[58] Field of Search ..... 430/569, 600, 613, 567

[56] References Cited

U.S. PATENT DOCUMENTS 3,622,318 11/1971 Evans ..... 430/383 X
3,982,948 9/1976 Sato et al. ..... 430/612 X
4,075,020 2/1978 Saleck et al. ..... 430/569
4,865,962 9/1989 Hasebe et al. ..... 430/567
4,892,809 1/1990 Momoki ..... 430/550

*Primary Examiner*—Charles L. Bowers, Jr.
*Assistant Examiner*—Janet C. Baxter
*Attorney, Agent, or Firm*—Burns, Doane, Swecker & Mathis

[57] ABSTRACT

Disclosed is a silver halide photographic material. The material comprises a support and at least one emulsion layer, wherein the emulsion layer includes a silver chlorobromide emulsion. The silver chlorobromide emulsion has been obtained by chemically sensitizing desalted silver chlorobromide grains in the presence of a nucleic acid or degradation product thereof at a pAg value ranging from about 6.5 to 7.5. The silver chlorobromide grains have been obtained by subjecting the surface of silver halide grains to halogen conversion, which silver halide grains are essentially silver iodide free and have a plurality of phases of which the halogen compositions substanially differ from each other.

19 Claims, No Drawings

SILVER HALIDE PHOTOGRAPHIC MATERIALS

FIELD OF THE INVENTION

This invention concerns silver halide photographic materials. More precisely, the invention concerns silver halide photographic materials which have high contrast and high photographic speed (sensitivity), while also exhibiting suppressed fogging during development.

BACKGROUND OF THE INVENTION

In recent years, higher photographic speeds and more rapid development processing have become increasingly important with silver halide photographic materials, especially with the photographic materials used for making prints. In the past, photographic emulsions containing silver chlorobromides which are essentially silver iodide free have been used for making prints due to the increased rate of development which can be obtained with these materials. While many attempts have been made to also increase the photographic speed of such emulsions there have been other problems such as low contrast or pressure resistance.

For example, although the emulsions prepared by halogen conversion disclosed in JP-B-50-36978 have higher photographic speeds, it has been found that they are readily desensitized when pressure is applied to the photographic material. (The term "JP-B" as used herein signifies an "examined Japanese patent publication".)

Techniques involving so-called "laminated type emulsions", in which the grains have a layer of a different halogen composition over an interior silver halide grain, have been disclosed, for example, in JP-B-56-18939, JP-A-58-9137, JP-A-58-95736, JP-A-58-108533, JP-A-60-222844 and JP-A-60-222845. However, it has been found that the contrast is likely to be soft in the toe part of the characteristic curve. It has also been discovered that desensitization by pressure is likely to arise. (The term "JP-A" as used herein signifies an "unexamined published Japanese patent application".)

The halogen converted layer type silver chlorobromide emulsions disclosed in JP-A-63-282730 have been found to have excellent pressure related properties, but have been found to be inadequate in terms of providing suitable photographic speed and contrast.

The use of sulfur sensitization or selenium sensitization has been preferred for the chemical sensitization of silver iodobromide emulsions which are to be used for making prints, since fogging is less likely to occur when these methods are used. Furthermore, the presence during chemical sensitization of nitrogen containing heterocyclic compounds such as azaindene compounds (e.g., 4-hydroxy-6-methyl-1,3,3a,7-tetra-azaindene) and/or mercaptoazole compounds (e.g., 1-phenyl-5-mercaptotetrazole and 2-amino-5-mercapto-1,3,4-thiadiazole), has been desirable.

However, even when these techniques have been used conjointly, it has been very difficult to prepare silver halide emulsions wherein there is no loss of photographic speed or contrast, and in which fogging during development is suppressed as well.

SUMMARY OF THE INVENTION

Accordingly, a primary object of the invention is to provide a silver halide photographic material which has high contrast and high photographic speeds, and in which fogging during development is suppressed.

It has been found that the aforementioned object of the invention can be obtained by using a silver halide photographic material including at least one emulsion layer on a support. The emulsion layer contains a silver chlorobromide emulsion which is obtained by chemically sensitizing de-salted silver chlorobromide grains in the presence of a nucleic acid or the degradation products thereof at a pAg value within the range of from 6.5 to 7.5; the de-salted silver chlorobromide grains themselves having been obtained by subjecting the surface of silver halide grains, which are essentially silver iodide free and which have a plurality of phases (part structures) of which the halogen compositions substantially differ from each other, to halogen conversion.

DETAILED DESCRIPTION OF THE INVENTION

The silver halide emulsions which are useful for use in the silver halide photographic material are essentially silver iodide free silver chlorobromide emulsions. Here, the term "essentially silver iodide free" signifies that the silver iodide content is not more than 1 mol.%, preferably not more than 0.5 mol.%. Most preferably the silver halide contains no silver iodide at all. The silver chlorobromides in the emulsions can have any silver chloride and silver bromide contents ranging from those approaching pure silver chloride to those approaching pure silver bromide, but a silver bromide content of at least 0.3 mol.% but not more than 97 mol.% is preferred. Most desirably, the silver bromide content is at least 0.5 mol.% but not more than 90 mol.%.

Emulsions which have a high silver bromide content are preferred for providing photographic materials which are stable with respect to fogging, photographic speed and gradation by means of the techniques of this present invention, and a silver bromide content of at least 45 mol.%, and preferably of at least 60 mol.%, is most desirable.

The crystalline grains contained in the silver chlorobromide emulsion must have a structure comprised of at least two parts; the silver bromide contents of which differ by at least 10 mol.%. The structure "comprised of at least two parts" as referred to herein may be so-called core/shell type structures in which the interior part and surface layer of the silver halide grains have a different halogen composition, or multi-layer core/shell structures.

Structures with parts having been formed in the ways indicated above may be such that the silver bromide content of the core part of a crystal grain having a core/shell structure, is high, while the shell part has a low silver bromide content; or vice versa. Furthermore, the boundaries between the parts having different halogen compositions may be distinct boundaries in terms of composition, or the boundaries may be of the type wherein there is a continuous change in composition with the formation of mixed crystals due to the difference in composition.

There is no particular requirement with regard to proportions of the two or more parts in the crystal grains which have different halogen compositions, but in the case of crystal grains which have a core/shell structure, for example, the mol ratio of the core/shell structure is between 2:98 and 98:2, preferably between 10:90 and 95:5, and more desirably between 40:60 and 90:10. Most desirably, the ratio is between 67:33 and 90:10.

The difference between the silver bromide content of the shell and core parts differs according to the structural proportions of the core and the shell, but it must be at least 10 mol.% and less than 100 mol.%. It is preferably at least 10 mol.% but not more than 50 mol.%. Most desirably, it is at least 15 mol.% and not more than 35 mol.%. If there is too little difference between the silver bromide content of the parts of the structure, there is little difference from grains which have a uniform structure. On the other hand, if the difference in composition is too large, then problems are liable to occur with performance. Such problems may include pressure desensitization. The appropriate difference in composition is dependent on the mol ratio of the part structure. A larger difference is preferred when approaching a structure mol ratio of 0:100 or 100:0, while a smaller difference in composition in the range above 10 mol.% is preferred at structure mol ratios close to 1:1.

Preferable grains of the silver chlorobromide emulsion are those having a structure of at least three parts and obtained by subjecting the surface of silver halide grains to halogen conversion, which silver halide grains are essentially silver iodide free and have a core/shell structure, the silver bromide contents of which core and shell differ by at least 10 mol% from each other. The other preferable silver chlorobromide grains are those obtained by subjecting the surface of silver halide grains to halogen conversion, which silver halide grains have a multilayer core/shell structure having a different silver bromide contents by at least 10 mol% from each other.

The term "halogen conversion" as used in connection with the present invention is best defined as the "conversion of the composition of a silver halide crystal which has been formed by the addition of a substance which contains halide ions which can form a more sparingly soluble silver salt". A typical example of halogen conversion is the reaction in which silver chloride is converted to silver bromide when potassium bromide is added to a pure silver chloride emulsion. In general, halogen conversion also includes those situations in which silver halide crystals, which are made to undergo halogen conversion, are mixed crystals such as silver chlorobromide crystals, and the reaction in which the surface of the silver halide is converted to a composition which is richer in silver bromide occurs when an amount of bromide ion in excess of the bromide ion concentration present in the solution at equilibrium is introduced into the solution.

The addition of the required quantity of bromide ion in the form of an aqueous bromide solution is a simple way of achieving halogen conversion at the surface of the grains. However, donors with which the amount of bromide ion supplied, or the rate at which the supply of bromide ion can be controlled, may also be used. For example, organic bromides, inorganic bromides which have an appropriate solubility in water, and encapsulated bromides or bromides which have been covered with a semipermeable membrane are suitable. Moreover, fine grains of a silver halide which has a higher silver bromide content prior to conversion than the surface of the grains which are to undergo halogen conversion, can also be used for this purpose.

The extent of halogen conversion in the present invention is preferably at least 0.5 mol.% and not more than 20 mol.% based on the total amount of silver halide. Most desirably it is at least 1 mol.% and not more than 15 mol.%. It is difficult to obtain the desired effect of the invention if the extent of halogen conversion is less than 0.5 mol.%, while undesirable desensitization by pressure becomes considerable if the extent of halogen conversion exceeds 20 mol.%.

Silver halide emulsions for the present invention can be manufactured by generally well known methods. An example is the formation of silver halide grains by reacting a water soluble silver salt with a water soluble halide, then a desalting process, and a chemical ripening process. The time during the aforementioned processes at which halogen conversion is carried out is preferably before chemical ripening, more desirably, before the desalting process, and most desirably, as a continuation of grain formation. Details of the desalting process are described in, e.g., *Shashin Kogaku no Kiso, Ginen Shashin-Hen* The Foundation of Photographic Technology, Section of Silver Halide type Photography) complied by Japanese Photographic Society, pages 250–251, Corona Publishing Co. Ltd. (1979). Also, details of the halogen conversion are described in, e.g., U.S. Pat. No. 3,622,318.

The nucleic acids which can be used in the present invention include deoxyribonucleic acids (DNA) and ribonucleic acids (RNA). Units such as adenine, guanine, uracil, cytosine and thymine, and products which are produced during degradation, are examples of nucleic acid degradation products. Adenine is an especially desirable nucleic acid degradation product. They can be used individually or in combinations. Likewise, combinations of nucleic acids and nucleic acid degradation products can also be used. The amount of nucleic acid or nucleic acid degradation products which should be added differs according to the type of nucleic acid degradation products, but should be at least 20 mg, and preferably within the range of from 100 mg to 1 gram, per mol of the silver halide. In those cases where nucleic acids or nucleic acid degradation products are used individually, or where combinations are used, the addition of a total amount as described above is satisfactory.

The silver halide emulsions in the silver halide emulsion layers are chemically sensitized after the nucleic acids or nucleic acid degradation products have been introduced. Sulfur sensitization is preferred for chemical sensitization, but other techniques such as reduction sensitization and gold sensitization, for example, can be used conjointly.

Chemical sensitization with sulfur can be carried out using active gelatin or compounds containing sulfur which are capable of reacting with silver (for example, thiosulfates, thioureas, mercapto compounds, rhodanines). Actual examples of these are disclosed, for example, in U.S. Pat. Nos. 1,574,944, 2,278,947, 2,410,689, 2,728,668 and 3,656,955.

Chemical sensitization must be carried out at a pAg value within the range of from 6.5 to 7.5. The pAg is defined as the logarithm of the reciprocal of the active mass of silver ion. The value can be obtained from the potential measured with respect to a standard hydrogen electrode using a silver electrode. This technique is described by T. H. James in The Theory of the Photographic Process, fourth edition, page 5 (Macmillan Co.).

It is known that the rate at which chemical sensitization proceeds varies according to conditions such as the pH and pAg, and that the reaction proceeds more rapidly as the pAg value falls, i.e., as the active mass of silver ion increases. Under these conditions fogging is more likely to occur.

If conventional methods were used at a relatively low pAg value as those within the range of pAg of the present invention for carrying out chemical sensitization of a silver chlorobromide emulsion, it would be difficult to overcome the problem of increased fogging. The results of fog suppression, high contrast and high photographic speed which can be obtained by the present invention are quite surprising. Furthermore, high photographic speed and contrast can be obtained if nucleic acids (or degradation products thereof) are present with the silver chlorobromide grains. The provision of high contrast, in particular, is quite unexpected since this result could not be realized using any of the other methods investigated during the research surrounding the development of the invention.

A pAg value range of from 6.7 to 7.5 is preferred in this present invention, and a pAg value within the range from 6.9 to 7.4 is most desirable. The pAg value should be maintained within this range for at least the first tenth, preferably at least the first fifth, and most desirably, at least the first half, of the total chemical sensitization time.

The silver chlorobromide emulsion grains used in the present invention may have a regular crystalline form, such as a cubic or octahedral form, or they may have an irregular crystalline form, such as a spherical or plate-like form, or they may have a crystalline form which is a composite of the aforementioned crystalline forms. Emulsions containing mixtures of grains which have various crystalline forms can be used, but the use of grains which have a regular crystalline form is preferred.

The silver halide emulsions used in the invention are preferably tabular grain emulsions in which grains having a thickness not more than 0.5 microns, preferably not more than 0.3 microns, and of diameter at least 0.6 microns, and of which the average aspect ratio is at least 5, account for at least 50% of the total projected area, and mono-disperse emulsions in which the statistical variation coefficient (the value $S/\bar{d}$ obtained by dividing the standard deviation S by the average diameter $\bar{d}$ for the distribution of diameters in which the projected areas are approximately circular) is not more than 20%. Furthermore, mixtures of two or more tabular grain and mono-disperse emulsions can be used.

The photographic emulsions used in the invention can be prepared, for example, by using the methods disclosed by P. Glafkides in *Chimie et Physique Photographique*, published by Paul Montel, 1967, by G. F. Duffin in Photographic Emulsion Chemistry, published by Focal Press, 1966, and by V. L. Zelikmann et al. in *Making and Coating Photographic Emulsions*, published by Focal Press, 1964.

Furthermore, silver halide solvents such as ammonia, potassium thiocyanate, ammonium thiocyanate, thioether compounds (e.g., those disclosed in U.S. Pat. Nos. 3,271,157, 3,574,628, 3,704,130, 4,297,439 and 4,276,374), thione compounds (e.g., those disclosed in JP-A-53-144319, JP-A-53-82408 and JP-A-55-77737), and amine compounds (e.g., those disclosed in JP-A-54-100717), can be used to control grain growth during the formation of the silver halide grains.

Cadmium salts, zinc salts, thallium salts, iridium salts or complex salts thereof, rhodium salts or complex salts thereof, and iron salts or complex salts thereof may be present during the formation or physical ripening of the silver halide grains.

Silver halide emulsions are usually subjected to spectral sensitization. Cyanine dyes, merocyanine dyes and complex merocyanine dyes, etc., can be used as spectral sensitizing dyes in the invention. Complex cyanine dyes, holopolar cyanine dyes, hemicyanine dyes, styryl dyes and hemioxonol dyes can also be used. Simple cyanine dyes, carbocyanine dyes and dicarbocyanine dyes are preferred. These cyanine dyes can be represented by formula (Ia) indicated below.

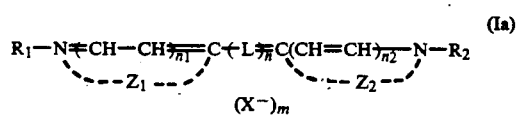

(Ia)

In this formula, L represents a methine group or a substituted methine group, $R_1$ and $R_2$ each represents an alkyl group or a substituted alkyl group, $Z_1$ and $Z_2$ each represents atomic groups which form a 5- or 6-membered nitrogen-containing heterocyclic ring and X represents an anion. Moreover, n has a value of 1,3 or 5, $n_1$ and $n_2$ are each 0 or 1, when n=5 both $n_1$ and $n_2$ are 0 and when n =3 then either one or both of $n_1$ or $n_2$ is 0. Moreover, m represents 0 or 1, being 0 when an intramolecular salt is formed. Furthermore, when n=5 the L groups may be linked to form a substituted or unsubstituted 5- or 6- membered ring.

Cyanine dyes which can be represented by formula (Ia) are described in detail below.

The substituent groups of the substituted methine groups which are represented by L may be lower alkyl groups (for example, methyl groups, ethyl groups, etc.) or aralkyl groups (for example, benzyl groups, phenethyl groups, etc.).

The alkyl group residues represented by $R_1$ and $R_2$ may be linear or branched or, alternatively, they may be cyclic groups. No limitation is imposed on the number of carbon atoms in these groups, but a group of 1 to 8 carbon atoms is preferred, and groups having from 1 to 4 carbon atoms are most preferred. The substituent groups of the substituted alkyl groups can be, for example, sulfonic acid groups, carboxylic acid groups, hydroxyl groups, alkoxy groups, acyloxy groups, or aryl groups (for example, phenyl groups, substituted phenyl groups, etc.). These groups may be bonded to the alkyl groups individually or in combinations of two or more. Furthermore, the sulfonic acid and carboxylic acid groups may be in the form of salts with alkali metal ions or quaternary salts of organic amines. When two or more groups are involved, they may each be bonded to the alkyl group individually, or they may be linked together and then bonded to the alkyl group. Cases of the latter type include, for example, sulfoalkoxyalkyl groups, sulfoalkoxyalkoxyalkyl groups, carboxyalkoxyalkyl groups and sulfophenylalkyl groups, etc.

Actual examples of $R_1$ and $R_2$ include methyl groups, ethyl groups, n-propyl groups, n-butyl groups, vinylmethyl groups, 2-hydroxyethyl groups, 4-hydroxybutyl groups, 2-acetoxyethyl groups, 3-acetoxypropyl groups, 2-methoxyethyl groups, 4-methoxybutyl groups, 2-carboxyethyl groups, 3-carboxypropyl groups, 2-(2-carboxyethoxy)ethyl groups, 2-sulfoethyl groups, 3-sulfopropyl groups, 3-sulfobutyl groups, 4-sulfobutyl groups, 2-hydroxy-3-sulfopropyl groups, 2-(3-sulfopropoxy)ethyl groups, 2-acetoxy-3-sulfopropyl groups, 3-methoxy-2-(3-sulfopropoxy)propyl groups, 2-[2-(3-sulfopropoxy)ethoxy]-ethyl groups and 2-hydroxy-3-(3'-sulfopropoxy)propyl groups, etc.

Actual examples of the nitrogen-containing heterocyclic rings which are formed by $Z_1$ and $Z_2$ include the oxazole nucleus, the thiazole nucleus, the selenazole nucleus, the imidazole nucleus, the pyridine nucleus, the oxazoline nucleus, the thiazoline nucleus, the selenazoline nucleus, the imidazoline nucleus and systems in which these nuclei are condensed with a benzene ring, a naphthalene ring or some other saturated or unsaturated carbon ring. Furthermore, these nitrogen-containing heterocyclic rings may be bonded with substituent groups (for example, alkyl groups, trifluoromethyl groups, alkoxycarbonyl groups, cyano groups, carboxylic acid groups, carbamoyl groups, alkoxy groups, aryl groups, acyl groups, hydroxyl groups, halogen atoms, etc.).

The anion which is represented by X may be $Cl^-$, $Br^-$, $I^-$, $SO_4^-$, $NO_3^-$, $ClO_4^-$, etc.

Actual examples of cyanine dyes which can be represented by formula (Ia) are indicated below.

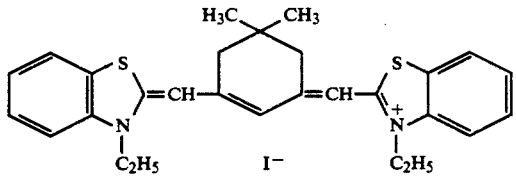
(V-1)

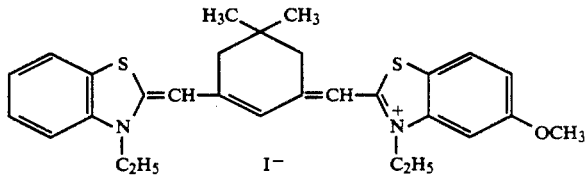
(V-2)

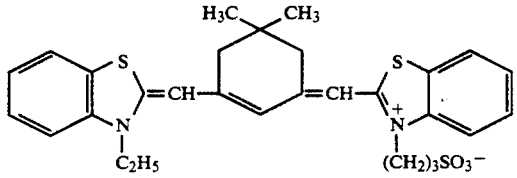
(V-3)

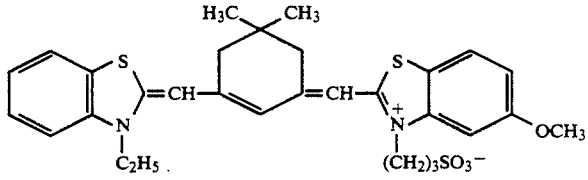
(V-4)

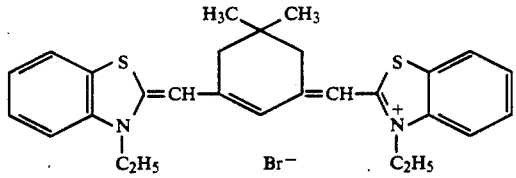
(V-5)

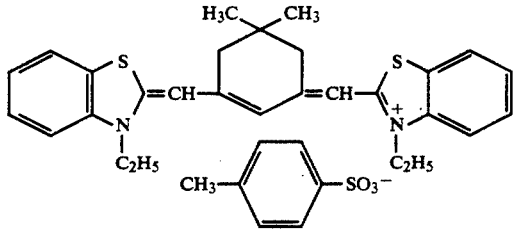
(V-6)

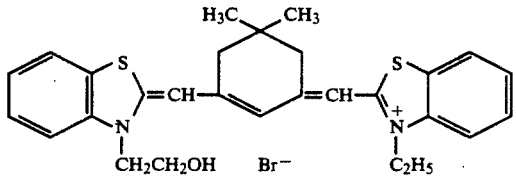
(V-7)

-continued
(V-8)
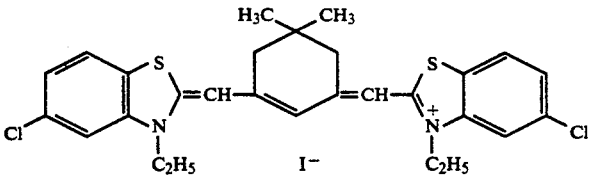
(V-9)
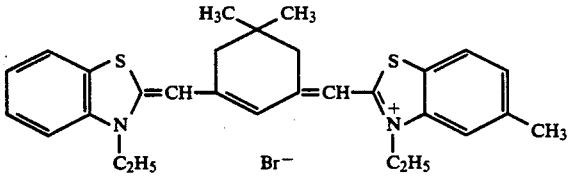
(V-10)
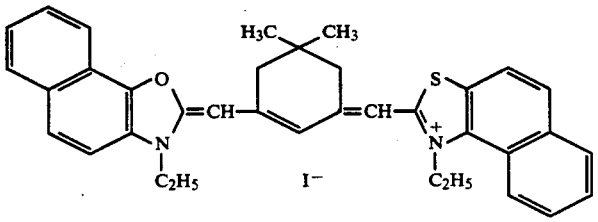
(V-11)
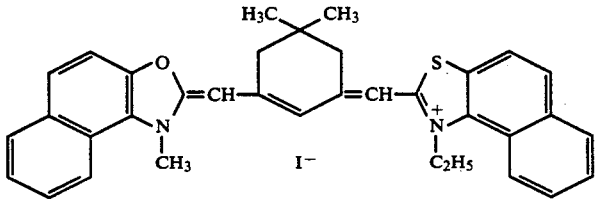
(V-12)
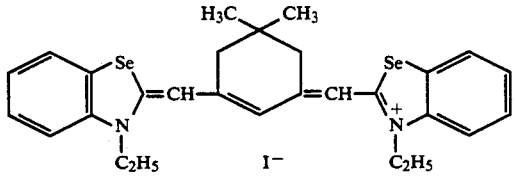
(V-13)
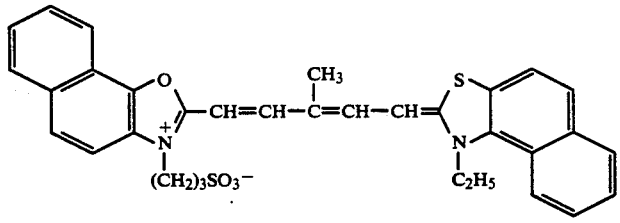
(V-14)
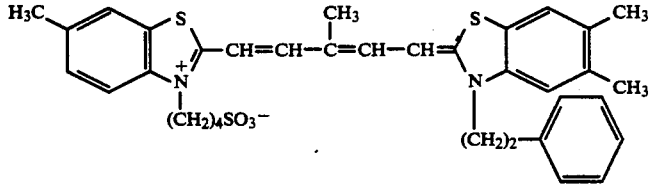
(V-15)
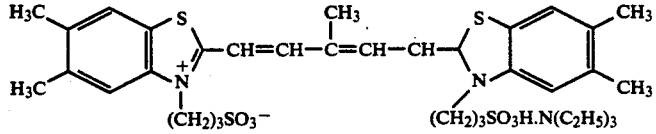

-continued
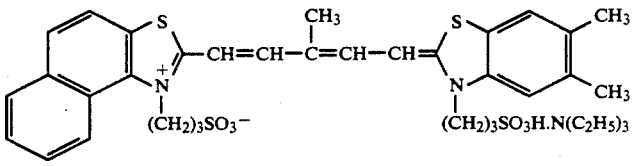
(V-16)
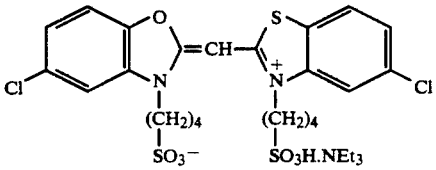
(V-17)
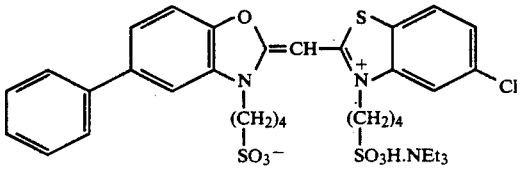
(V-18)
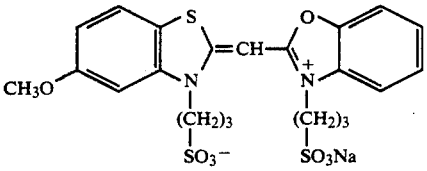
(V-19)
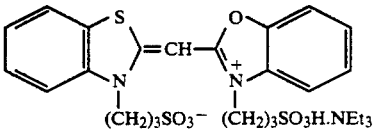
(V-20)
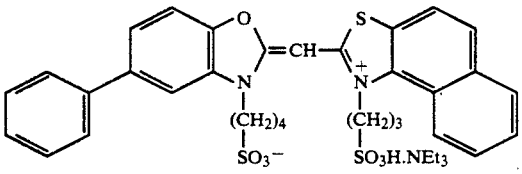
(V-21)
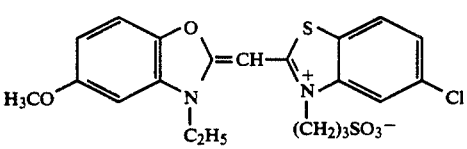
(V-22)
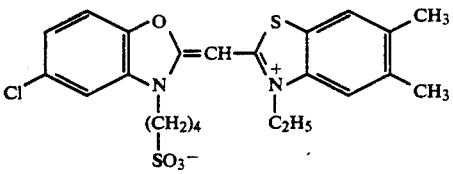
(V-23)
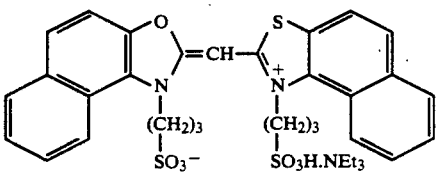
(V-24)

-continued
(V-25)
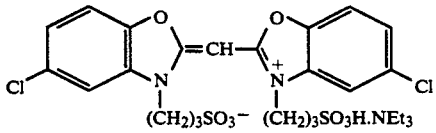
(V-26)
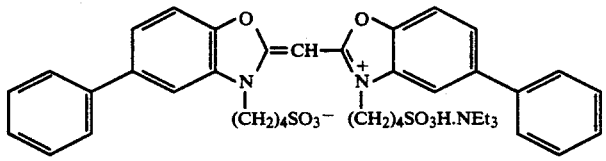
(V-27)
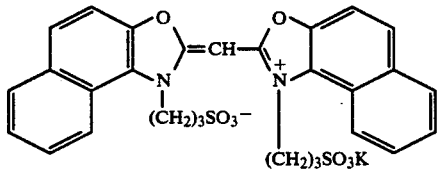
(V-28)
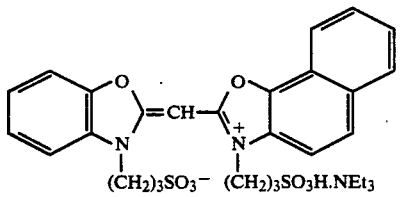
(V-29)
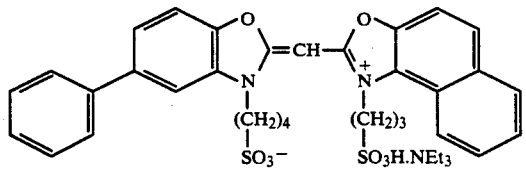
(V-30)
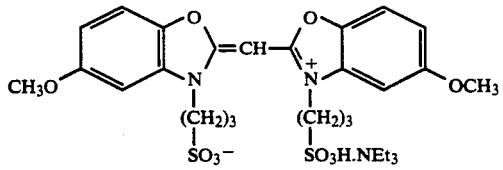
(V-31)
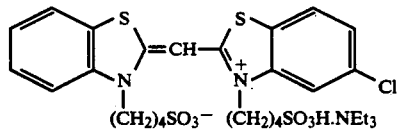
(V-32)
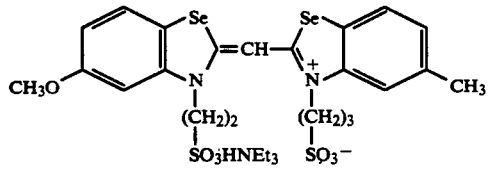
(V-33)
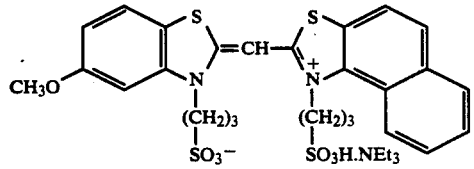

-continued
(V-34)
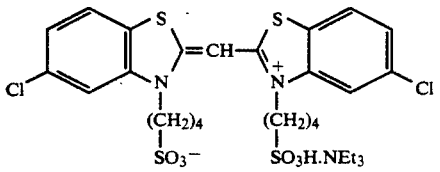
(V-35)
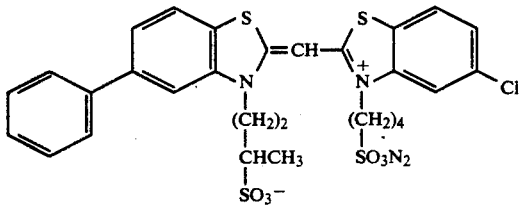
(V-36)
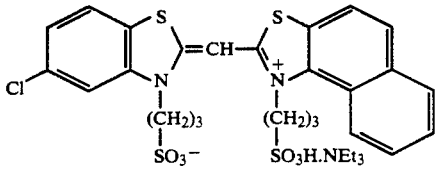
(V-37)
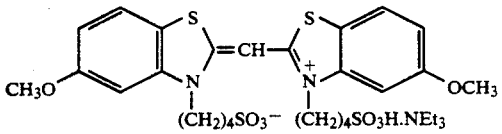
(V-38)
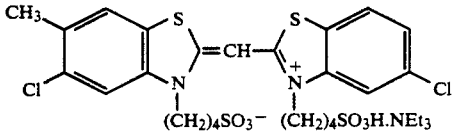
(V-39)
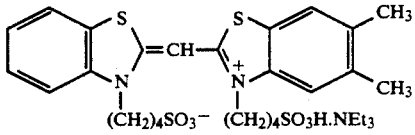
(V-40)
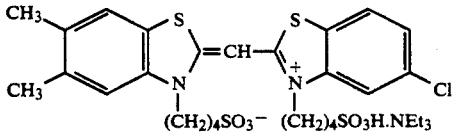
(V-41)
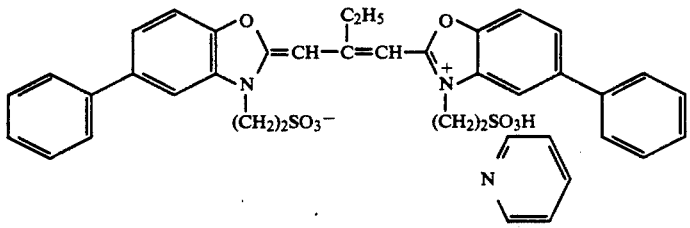
(V-42)
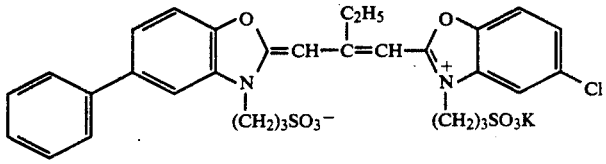

-continued
(V-43)
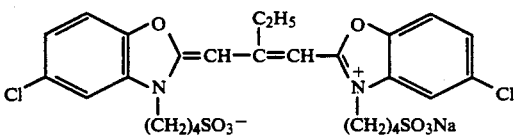
(V-44)
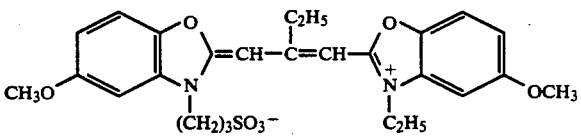
(V-45)
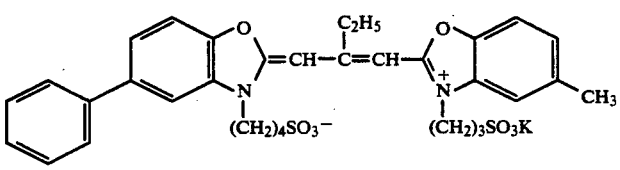
(V-46)
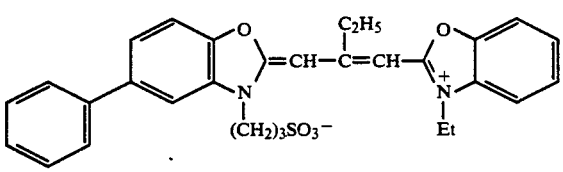
(V-47)
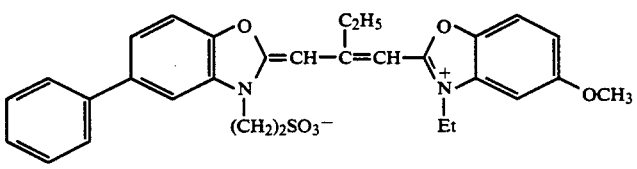
(V-48)
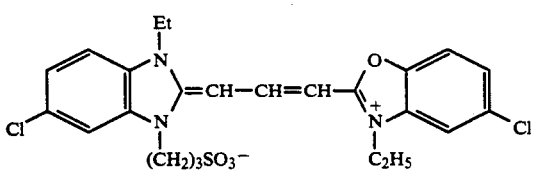
(V-49)
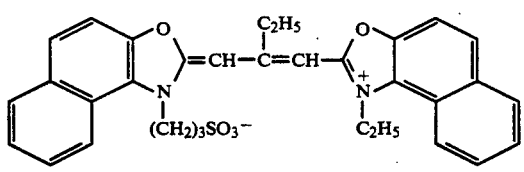
(V-50)
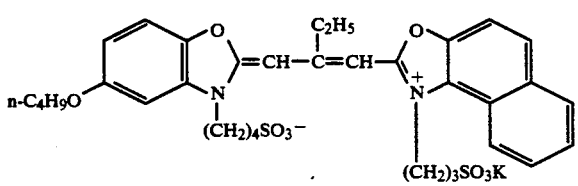
(V-51)
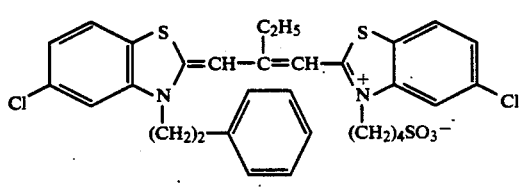

-continued (V-52)

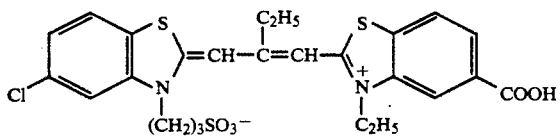

(V-53)

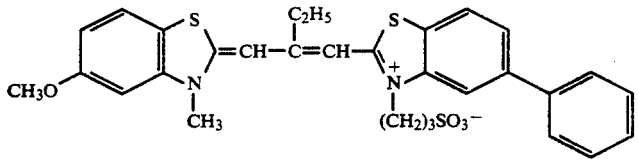

(V-54)

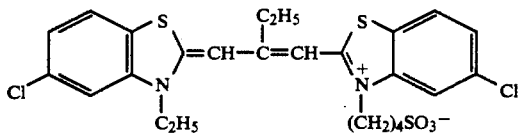

(V-55)

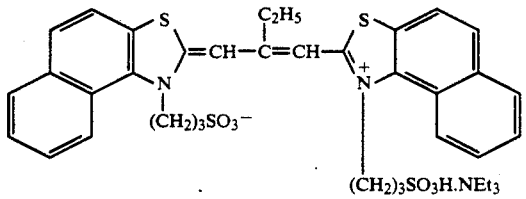

(V-56)

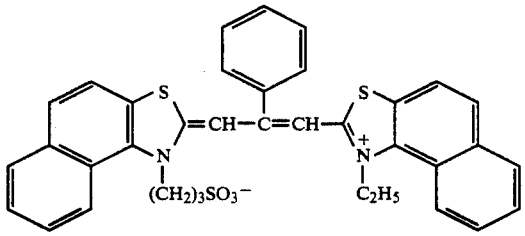

A 5- or 6-membered nucleus, such as a pyrazoline-5-one nucleus, a thiohydantoin nucleus, a 2-thiooxazolidine-2,4-dione nucleus, a thiazolidine-2,4-dione nucleus, a rhodanine nucleus or a thiobarbituric acid nucleus, etc., can be incorporated as the nucleus which has a ketomethylene structure in the merocyanine dyes or complex merocyanine dyes.

Spectral sensitizing dyes other than those described above, which incorporate a pyrroline nucleus, an oxazoline nucleus, a thiazoline nucleus, a pyrrole nucleus, a thiazole nucleus, an oxazole nucleus, a selenazole nucleus, an imidazole nucleus, a tetrazole nucleus or a pyridine nucleus or a nucleus in which these rings are fused with an alicyclic hydrocarbon ring or an aromatic hydrocarbon ring, can also be used in the invention.

Useful spectral sensitizing dyes are disclosed, for example, in German Patent 929,080, U.S. Pat. Nos. 2,231,658, 2,493,748, 2,503,776, 2,519,001, 2,912,329, 3,656,959, 3,672,897, 3,694,217, 4,025,349 and 4,046,572, British Patent 1,242,588 and Japanese Patent Publication Nos. 14030/69 and 24844/77.

Of the dyes referred to above, the use of those which have a benzothiazole nucleus or a benzoxazole nucleus are preferred in this invention. The use of simple cyanine dyes which have a benzothiazole nucleus, carbocyanine dyes which have a benzoxazole nucleus and dicarbocyanine dyes which have a benzothiazole nucleus is more preferred.

Normally, methods in which the spectral sensitizing dye is adsorbed on the surface of the grains after the grains have been formed completely are used to achieve the spectral sensitization of silver halide emulsions. On the other hand, methods in which a merocyanine dye is added during the precipitation and formation of the silver halide grains is disclosed in U.S. Pat. No. 2,735,766. This enables the amount of unadsorbed dye to be reduced. Furthermore, a method in which the spectral sensitizing dye is added and adsorbed during the addition of the aqueous silver salt solution and the aqueous halide solution, which are used to form the silver halide crystal grains, is disclosed in Japanese Patent Application (OPI) No. 26589/80. Thus, the addition of the spectral sensitizing dye can be made during the formation of the silver halide crystal grains after the formation of the crystal grains has been completed or before forming the crystal grains. In practice, there are methods in which the spectral sensitizing dye is introduced into the reaction vessel before starting the reaction in which the silver halide crystals are formed in the case of addition before formation of the crystal grains. Also, there exist methods, such as those disclosed in the aforementioned patent specifications, wherein addition during grain formation, and addition after grain formation, the dyes are added and adsorbed after the grain formation has been essentially completed. The silver halide emulsions of this invention are chemically sensitized after grain formation has been completed, and the addition of the spectral sensitizing dyes after grain formation has been completed may take place before the start of chemical sensitization, during the chemical sensitization or after the chemical sensitization as been completed. Moreover, it can also be carried out when the emulsion is being coated. In this invention, the addition of spectral sensitizing dyes of the type described above is preferably achieved by adding and adsorbing the dye in at least one process at any stage after the process in which the formation of the silver halide grains has been essentially completed. The dyes may be together or divided and added in two or more processes. Even when added during a single process, the addition can be intensive over a short time or continuous over a longer period of time. Moreover, combinations of these methods of addition can be used.

The spectral sensitizing dyes may be added as untreated crystals or as powders, but they are preferably added using some method of dissolution or dispersion. Water-soluble solvents such as alcohols with from 1 to 3 carbon atoms, acetone, pyridine and methyl cellosolve or mixtures of these solvents can be used for dissolution. Moreover, surfactants can be used to form micelle dispersions or other types of dispersion.

The amount of spectral sensitizing dye added is determined in accordance with the intended purpose of the spectral sensitization and the silver halide emulsion content, but it is normally from $1\times10^{-6}$ to $1\times10^{-2}$ mol/mol of silver halide, and preferably from $1\times10^{-5}$ to $5\times^{-3}$ mol/mol of silver halide.

The spectral sensitizing dyes used in the invention can be used individually or in combinations of two or more.

In this invention, it is effective to use supersensitizers.

As for the supersensitizers, there are descriptions in *Photographic Science and Engineering*, Vol. 13, pp. 13–17 (1969); ibid . Vol. 18, pp. 418–430 1974); T. H. James, *The Theory of the Photographic Process*, 4th Ed., p. 259, Macmillan Publishers (1977); and so on. As well known, higher sensitivities can be achieved by choosing proper combinations of sensitizing dyes with supersensitizers.

Although it is possible to use any kind of supersensitizer, compounds represented by the following general formula (Ib) are particularly preferred in this invention:

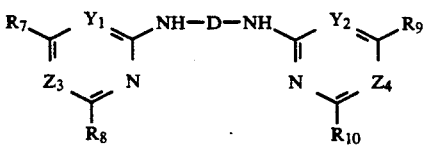

(Ib)

wherein D represents a divalent aromatic group; $R_7$, $R_8$, $R_9$ and $R_{10}$ each represents a hydrogen atom, a hydroxy group, an alkoxy group, an aryloxy group, a halogen atom, a heterocyclic group, a mercapto group, an alkylthio group, an arylthio group, a heterocyclic thio group, an amino group, an alkylamino group, a cyclohexylamino group, an arylamino group, a heterocyclic amino group, an aralkylamino group, or an aryl group; $Y_1$ and $Z_3$ each represents —N=or —CH=, provided that at least either of them is —N=; and $Y_2$ and $Z_4$ have the same meaning as $Y_1$ and $Z_3$, respectively.

More specifically, D represents a divalent aromatic group (e.g., a residue of a single aromatic nucleus, a residue of a condensed aromatic nucleus in which at least two aromatic nuclei are fused together, a link formed by bonding at least two aromatic nuclei directly or via atom(s) or group(s)), with specific examples including biphenyl, naphthylene, stilbene, those having a dibenzyl skeleton, and so on. In particular, those shown below as $D_1$ and $D_2$ are preferred.

$D_1$:

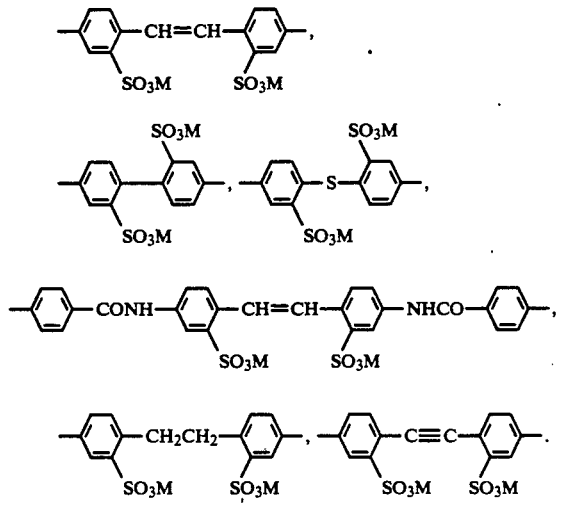

wherein M represents a hydrogen atom, or a cation capable of imparting solubility in water to the compound (e.g., alkali metal ions ($Na^+$, $K^+$), ammonium ion).

$D_2$:

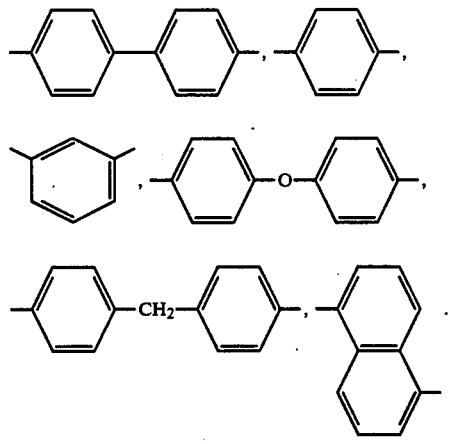

In the case of $D=D_2$, at least one from among $R_7$, $R_8$, $R_9$ and $R_{10}$ has a substituent group containing at least one $SO_3M$ group, where M has the same meaning as above.

$R_3$, $R_4$, $R_5$ and $R_6$ each represents a hydrogen atom, a hydroxyl- group, an alkoxy group (e.g., methoxy, ethoxy), an aryloxy group (e.g., phenoxy, naphthoxy, o-tolyloxy, p-sulfophenoxy), a halogen atom (e.g., chlorine, bromine), a heterocyclic group (e.g., morpholinyl, piperidyl), a mercapto group, an alkylthio group (e.g., methylthio, ethylthio), an arylthio group (e.g., phenylthio, tolylthio), a heterocyclic thio group (e.g., benzothiazolylthio, benzimidazolylthio, phenyltetrazolylthio), an amino group, an alkylamino group (e.g., methylamino, ethylamino, propylamino, dimethylamino, diethylamino, dodecylamino, β-hydroxyethylamino, di-β-hydroxyethylamino, β-sulfoethylamino), a cyclohexylamino group, an arylamino group (e.g., anilino, o-, m- or p-sulfoanilino, o-, m- or p-chlorcanilino, o-, m- or p-anisidino, o-, m- or p-toluidino, o-, m- or p-carboxyanilino, hydroxyanilino, sulfonaphthylamino, o-, m- or p-aminoanilino, o-acetaminoanilino), a heterocyclic amino group (e.g., 2-benzothiazolylamino, 2-pyridylamino), an aralkylamino group (e.g., benzylamino) or an aryl group (e.g., phenyl).

Among the compounds represented by general formula (Ib), those containing an aryloxy group, a heterocyclic thio group or a heterocyclic amino group as at least one substituent among $R_7$, $R_8$, $R_9$ and $R_{10}$ are particularly preferred.

Typical representatives of the compounds represented by general formula (Ib) are given below. However, the invention should not be construed as being limited to these compounds.

(A-1) : Disodium 4,4'-bis[2,6-di(benzothiazolyl-2-disulfonate (A-2) : Disodium 4,4'-bis[2,6-di(benzothiazolyl-2-amino)pyrimidine-4-ylamino]stilbene-2,2'-disulfonate (A-3) : Disodium 4,4'-bis[2,6-di(1-phenyltetrazolyl-5-thio)pyrimidine-4-ylamino]stilbene-2,2'-disulfonate (A-4) : Disodium 4,4'-bis[2,6-di(benzoimidozolyl-2thio)-pyrimidine-4-ylamino ]stilbene-2,2'-disulfonate (A-5): Disodium 4,4'-bis[2-chloro-6-(2-naphthyloxy)-pyrimidine-4-ylamino]biphenyl-2,2'-disulfonate (A-6) : Disodium 4,4'-bis[2,6-di(naphthyl-2-oxy)-pyrimidine-4-ylamino]stilbene-2,2'-disulfonate (A-7) : Disodium 4,4'-bis[2,6-di(naphthyl-2-oxy)-pyrimidine-4-ylamino]bibenzyl-2,2'-disulfonate (A-8) : Disodium 4,4'-bis(2,6-diphenoxypyrimidine-4-ylamino)stilbene-2,2'-disulfonate (A-9) : Disodium 4,4'-bis(2,6-diphenylthiopyrimidine-4-ylamino)stilbene-2,2'-disulfonate (A-10) : Disodium 4,4'-bis(2,6-dichloropyrimidine-4-ylamino]stilbene-2,2'-disulfonate (A-11) : Disodium 4,4'-bis(2,6-dianilinopyrimidine-4-ylamino)stilbene-2,2'-disulfonate (A-12) : Disodium 4,4'-bis[4,6-di(naphthyl-2-oxy)-triazine-4-ylamino]stilbene-2,2'-disulfonate (A-13) : Disodium 4,4'-bis(4,6-dianilinotriazine-4-ylamino)stilbene-2,2'-disulfonate (A-14) : Disodium 4,4'-bis(2,6-diphenylthiopyrimidine-4-ylamino)stilbene-2,2'-disulfonate (A-15) : Disodium 4,4'-bis[4,6-di(naphthyl-2-oxy)-pyrimidine-2-ylamino]stilbene-2,2'-disulfonate (A-16) : Disodium 4,4'-bis[4,6-di(benzothiazolyl-2-thio)-pyrimidine-2-ylamino]stilbene-2,2'disulfonate (A-17) : Disodium 4,4'-bis[4,6-di(1-phenyltetrazolyl-2-amino)pyrimidine-2-ylamino]stilbene-2,2'-disulfonate A-18) : Disodium 4,4'-bis[4,6-di(naphthyl-2-oxy)-pyrimidine-2-ylamino]bibenzyl-2,2'-disulfonate As for the addition order of the foregoing compounds represented by general formulae (Ia) and (Ib), either of them may be added first, or they may be added at the same time. Also, they can be added in the form of a mixed solution.

The amount of compound represented by general formula (Ib) added is from $1\times10^{-6}$ to $1\times10^{-1}$ mol, preferably from $5\times10^{-5}$ to $1\times10^{-2}$ mol, per mol of silver halide.

Various compounds can be included in the silver halide photographic emulsions with a view to preventing the occurrence of fogging during the manufacture, storage or photographic processing of the photographic materials, or stabilizing photographic characteristics. Thus, many compounds which are known as anti-fogging agents or stabilizers, such as azoles (e.g., benzothiazolium salts, nitroindazoles, triazoles, benzotriazoles and benzimidazoles (especially nitro or halogen substituted derivatives)); heterocyclic mercapto compounds (e.g., mercaptothiazoles, mercaptobenzothiazoles, mercaptobenzimidazoles, mercaptothiadiazoles, mercaptotetrazoles (especially 1-phenyl-5-mercaptotetrazole and substituted phenyl derivatives) and mercaptopyrimidines); heterocyclic mercapto compounds such as those described above but which have water solubilizing groups such as carboxyl groups and sulfo groups; thioketo compounds (e.g., oxazolinthione); azaindenes (e.g., tetraazaindenes (especially 4-hydroxy substituted (1,3,3a,7-tetraazaindenes))); benzenethiosulfonic acids; and benzenenitrogen sulfinic acids.

Actual examples of preferred compounds are disclosed on pages 40 to 72 of the specification of JP-A-62-215272.

Yellow couplers, magenta couplers and cyan couplers which form yellow, magenta and cyan colorations on coupling with the oxidized form of an aromatic amine developing agent, are normally used in the photographic materials when the invention is applied to color photographic materials. Certain preferred cyan couplers, magenta couplers and yellow couplers are represented by the general formulae (I), (II), (III), (IV) and (V) set forth below.

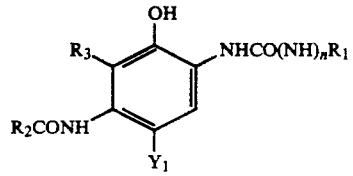

(I)

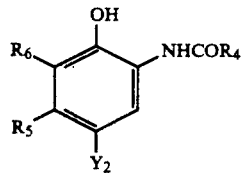

(II)

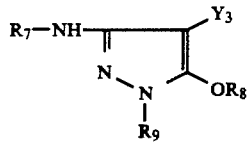

(III)

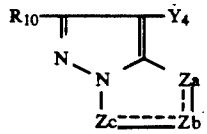

(IV)

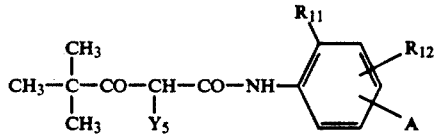

(V)

In general formula (I) and (II), $R_1$, $R_2$ and $R_4$ represent substituted or unsubstituted aliphatic, aromatic or heterocyclic groups; $R_3$, $R_5$ and $R_6$ represent hydrogen atoms, halogen atoms, aliphatic groups, aromatic groups or acylamino groups, and $R_3$ may represents a group of non-metal atoms which, together with $R_2$, forms a five or six membered nitrogen containing ring. $Y_1$ and $Y_2$ represent hydrogen atoms or groups which can be eliminated at the time of the coupling reaction with the oxidized form of a developing agent.

$R_5$ in general formula (II) is preferably an aliphatic group such as methyl, ethyl, propyl, butyl, pentadecyl, tert-butyl, cyclohexyl, cyclohexylmethyl, phenylthiomethyl, dodecyloxyphenylthiomethyl, butanamidomethyl or methoxymethyl.

More preferred examples of cyan couplers represented by the aforementioned general formula (I) or (II) are described below.

$R_1$ in general formula (I) is preferably an aryl group or a heterocyclic group, and aryl groups substituted with halogen atoms, alkyl groups, alkoxy groups, aryloxy groups, acylamino groups, acyl groups, carbamoyl groups, sulfonamido groups, sulfamoyl groups, sulfonyl groups, sulfamido groups, oxycarbonyl groups and cyano groups; are especially desirable.

In cases where $R_3$ and $R_2$ in general formula (I) do not form a ring, $R_2$ is preferably a substituted or unsubstituted alkyl group or aryl group, and most desirably a substituted aryloxy substituted alkyl group, and $R_3$ is preferably a hydrogen atom.

$R_4$ in general formula (II) is preferably a substituted or unsubstituted alkyl group or aryl group, and most desirably a substituted aryloxy substituted alkyl group.

$R_5$ in general formula (II) is preferably an alkyl group which has from 2 to 15 carbon atoms or a methyl group which has a substituent group which has at least 1 carbon atom, with the preferred substituent groups being arylthio groups, alkylthio groups, acylamino groups, aryloxy groups and alkyloxy groups.

$R_5$ in general formula (II) is most desirably an alkyl group which has from 2 to 15 carbon atoms, and alkyl groups which have from 2 to 4 carbon atoms are especially desirable.

$R_6$ in general formula (II) is preferably a hydrogen atom or a halogen atom, and most desirably a chlorine atom or a fluorine atom.

$Y_1$ and $Y_2$ in general formulae (I) and (II) each preferably represents a hydrogen atom, a halogen atom, an alkoxy group, an aryloxy group, an acyloxy group or a sulfonamido group.

In general formula (III), $R_7$ and $R_9$ represent aryl groups, $R_8$ represents a hydrogen atom, an aliphatic or aromatic acyl group, or an aliphatic or aromatic sulfonyl group, and $Y_3$ represents a hydrogen atom or a releasing group. The substituent groups permitted for the aryl groups (preferably phenyl groups) represented by $R_7$ and $R_9$ are the same as those permitted as substituent groups for $R_1$. When there are two or more substituent groups, they may be the same or different. $R_8$ is preferably a hydrogen atom, an aliphatic acyl group or a sulfonyl group, and most desirably, a hydrogen atom. $Y_3$ is preferably a group of the type which is eliminated at a sulfur, oxygen or nitrogen atom, and most desirably, a sulfur atom releasing group of the type disclosed, for example, in U.S. Pat. No. 4,351,897 or WO88/04795.

In general formula (IV), $R_{10}$ represents a hydrogen atom or a substituent group. $Y_4$ represents a hydrogen atom or a releasing group, preferably a halogen atom or a arylthio group, Za, Zb and Zc represent methine groups, substituted methine groups, =N— groups or —NH— groups, and one of the bonds Za-Zb and Zb-Zc is a double bond and the other is a single bond. Those cases where Zb - Zc is a carbon —carbon double bond include those situations in which this bond is part of an aromatic ring. Cases where a dimer or larger oligomer is formed via $R_{10}$ or $Y_4$, and cases in which Za, Zb or Zc is a substituted methine group and a dimer or larger oligomer is formed via the substituted methine group, are included.

Among the pyrazoloazole based couplers represented by general formula (IV), the imidazo[1,2-b]pyrazoles disclosed in U.S. Pat. No. 4,500,630 are preferred from the point of view of the slight absorbance on the yellow side and the light fastness of the colored dye. The pyrazolo-[1,5-b][1,2,4]triazole disclosed in U.S. Pat. No. 4,540,654 is especially desirable.

The use of the pyrazolotriazole couplers in which a branched alkyl group is bonded directly to the 2-, 3- or 6-position of the pyrazolotriazole ring (see JP-A-61-65245), pyrazoloazole couplers which have a sulfonamide group within the molecule (see JP-A-61-65246), pyrazoloazole couplers which have alkoxyphenylsulfonamido ballast groups (see JP-A-61-147254), and pyrazolotriazole couplers which have an alkoxy group or an aryloxy group in the 6-position (see European Patent Publication No. 226,849), are also desirable.

In general formula (V), $R_{11}$ represents a halogen atom or an alkoxy group, and $R_{12}$ represents a hydrogen atom, a halogen atom or an alkoxy group. A represents $—NHCOR_{13}$, $$—COOR_{13} \text{ or } —SO_2\underset{\underset{R_{14}}{|}}{N}—R_{13},$$

where $R_{13}$ and $R_{14}$ each represents an alkyl group. $Y_5$ represents a releasing group. The substituent groups for $R_{12}$, and $R_{13}$, $R_{14}$, are the same as the substituent groups permitted for $R_1$, and the releasing group $Y_5$ is preferably a group of the type at which elimination occurs at an oxygen atom or nitrogen atom, most desirably it is of the nitrogen atom elimination type.

Actual examples of couplers which can be represented by general formulae (I)–(V) are indicated below.

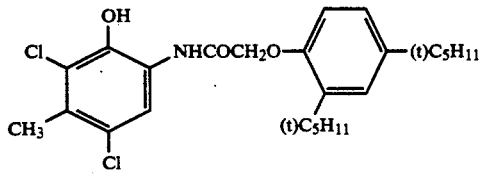

(C-1)

-continued
(C-2)
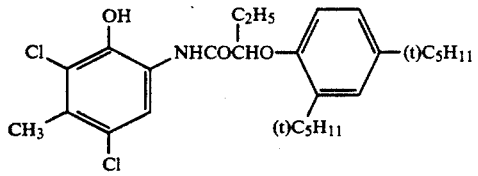
(C-3)
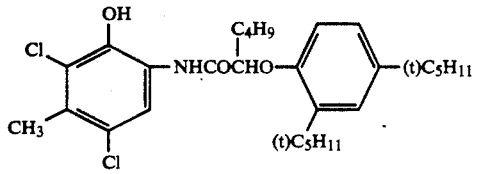
(C-4)
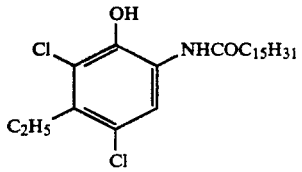
(C-5)
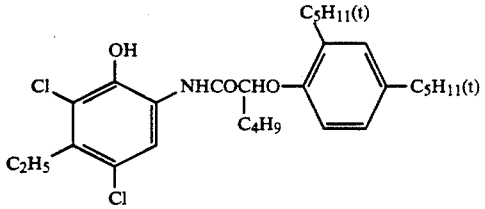
(C-6)
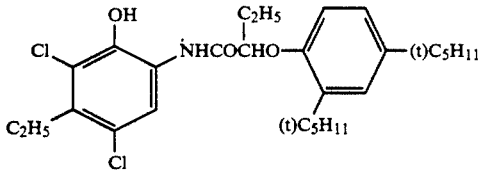
(C-7)
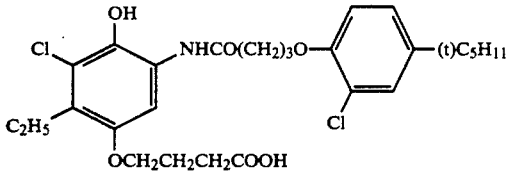
(C-8)
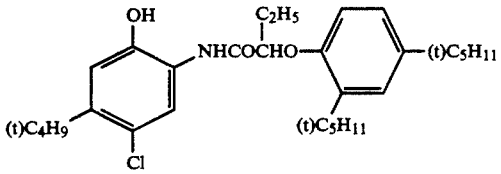
(C-9)
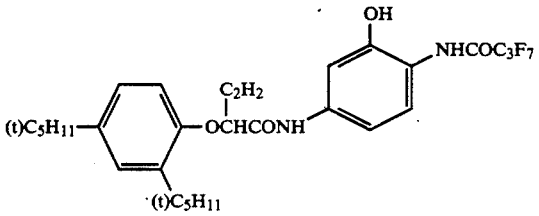

-continued
(C-10)
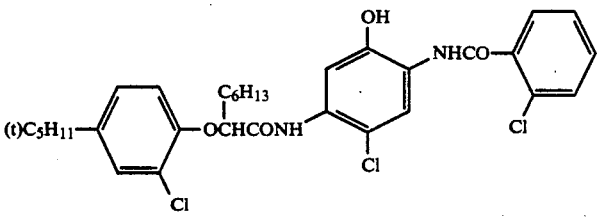
(C-11)
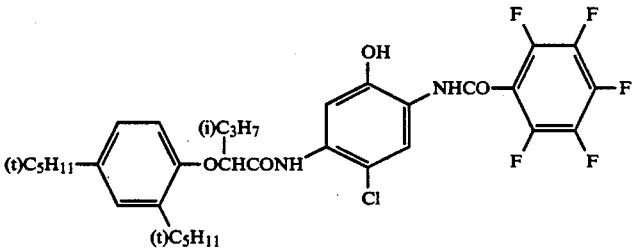
(C-12)
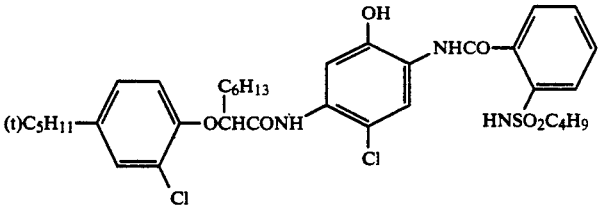
(C-13)
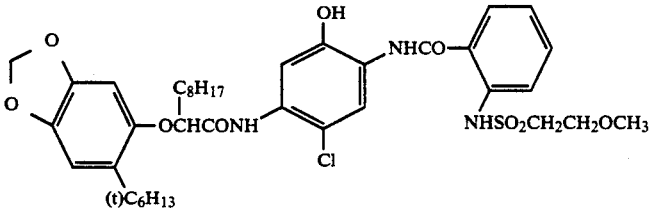
(C-14)
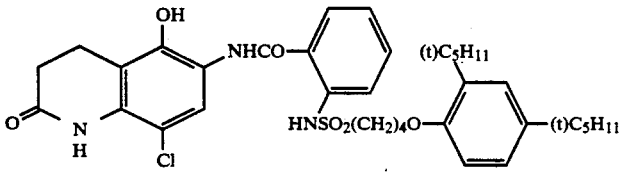
(C-15)
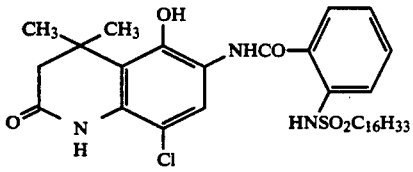
(C-16)
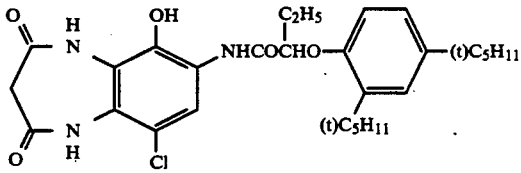

-continued
(C-17)
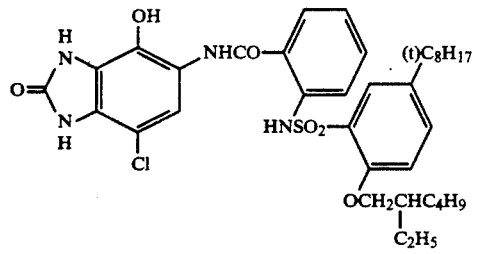
(C-18)
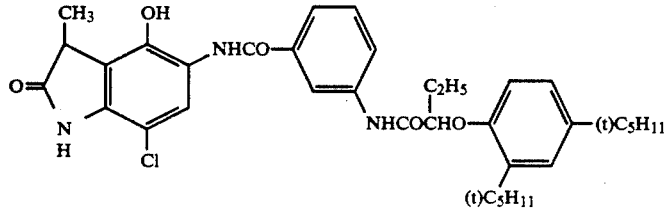
(C-19)
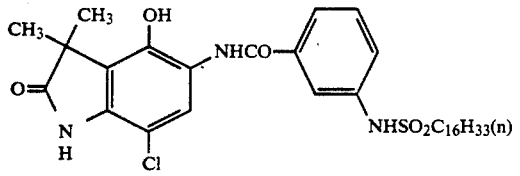
(C-20)
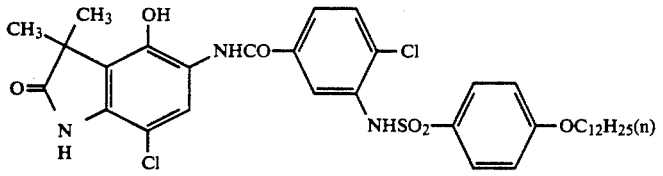
(C-21)
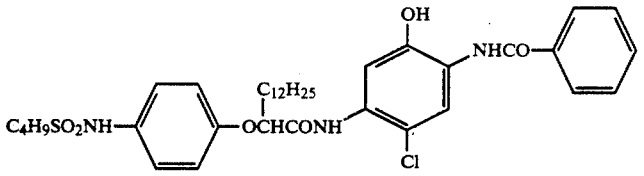
(C-22)
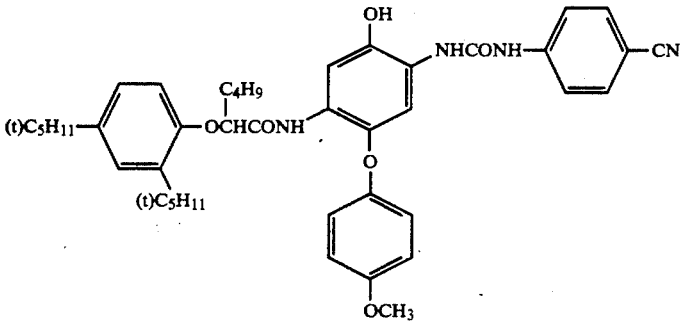

-continued
(M-1)
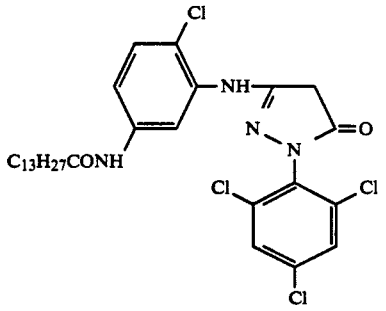
(M-2)
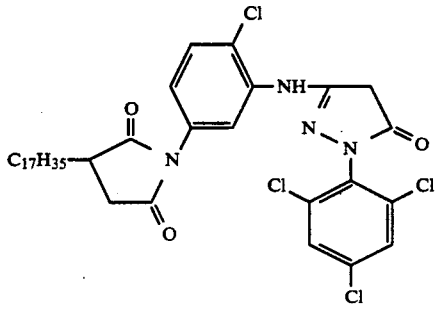
(M-3)
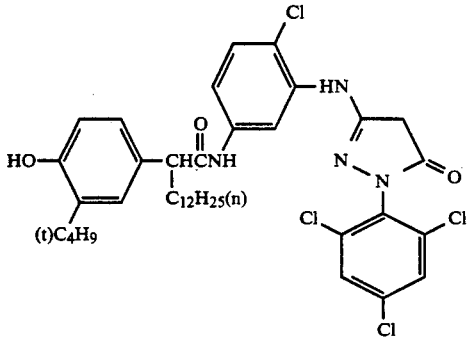
(M-4)
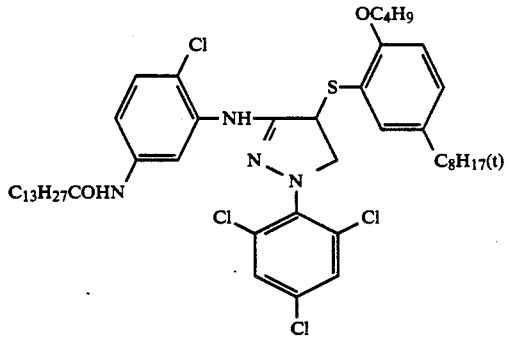
(M-5)
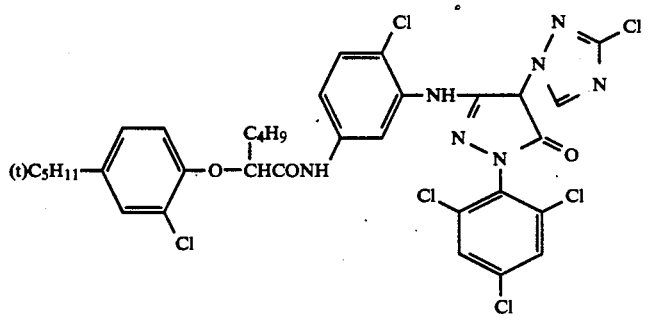

-continued
(M-6)
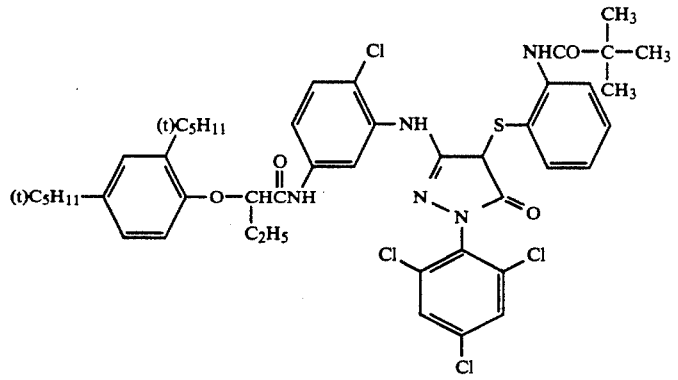
(M-7)
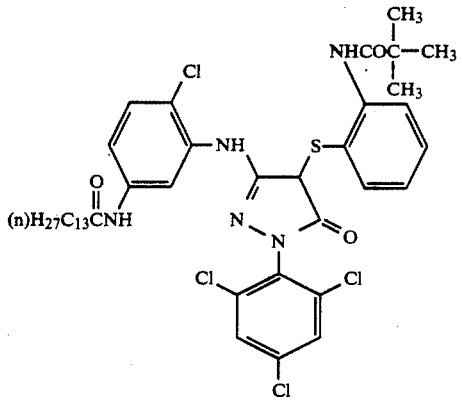
(M-8)
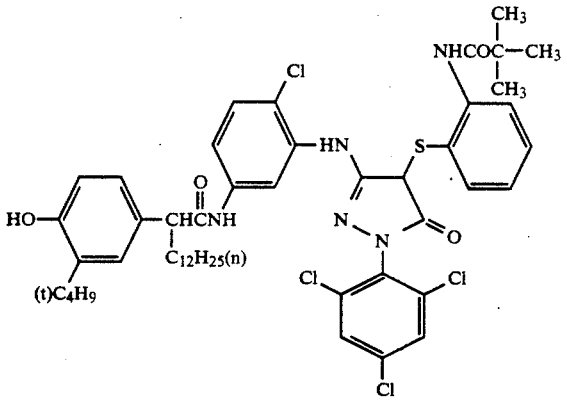
(M-9)
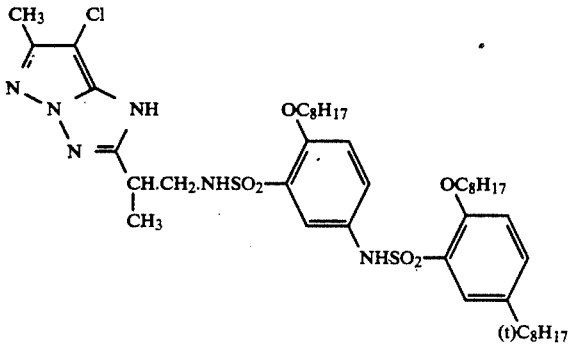

-continued
(M-10)
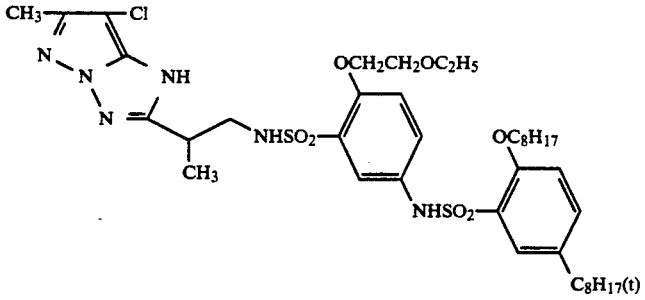
(M-11)
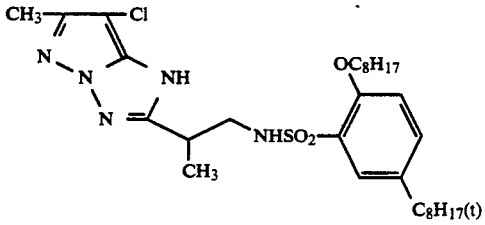
(M-12)
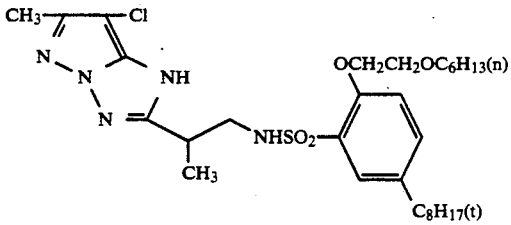
(M-13)
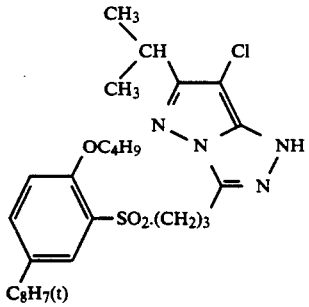
(M-14)
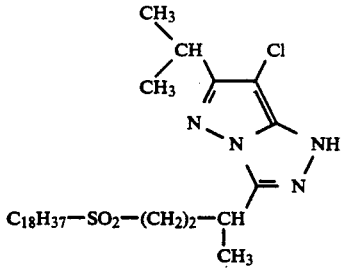
(M-15)
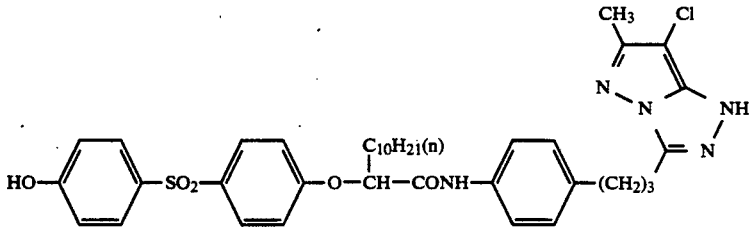

-continued
(M-16)
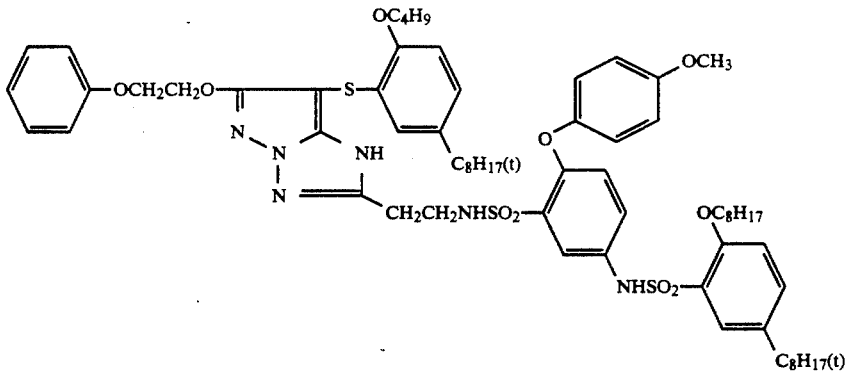
(M-17)
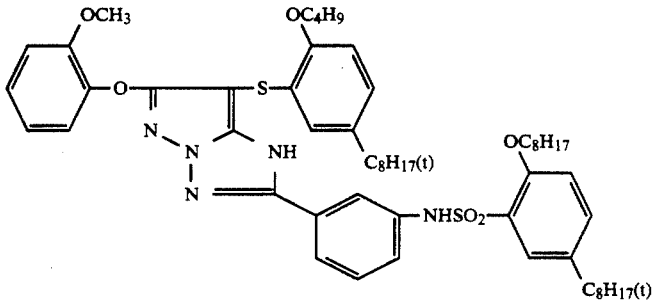
(M-18)
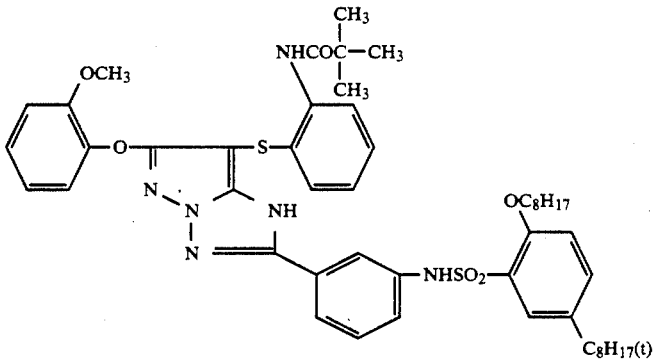
(Y-1)
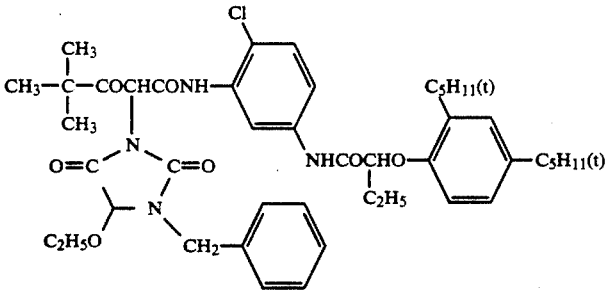
(Y-2)
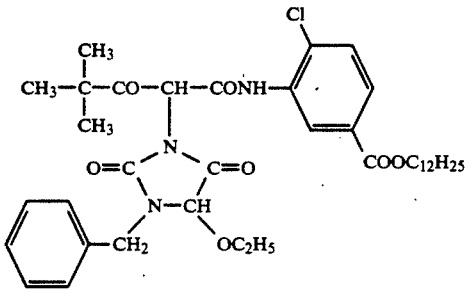

-continued
(Y-3)
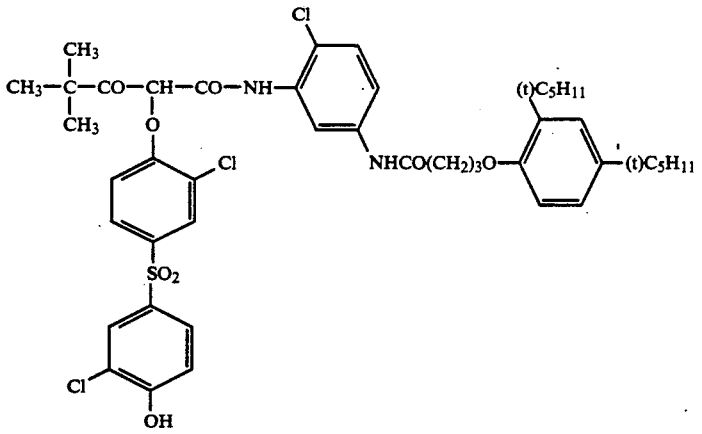
(Y-4)
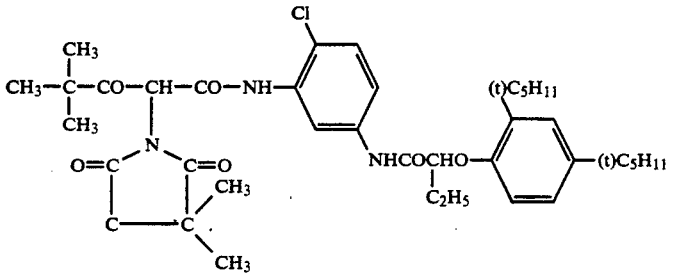
(Y-5)
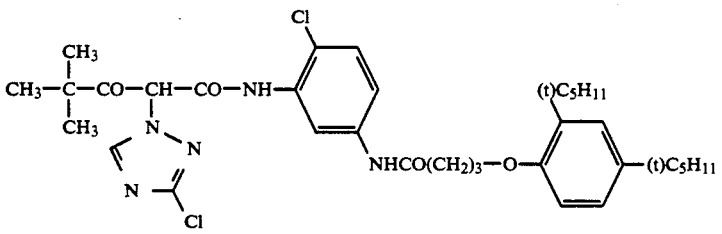
(Y-6)
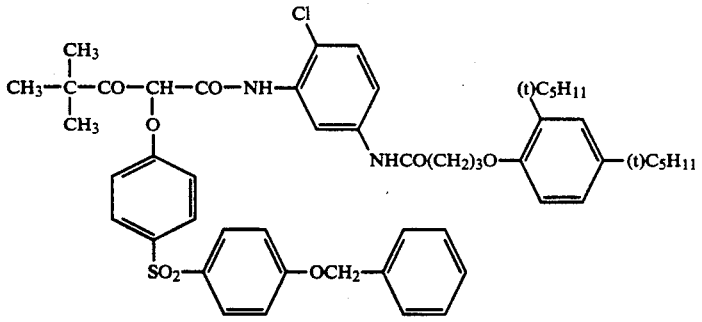
(Y-7)
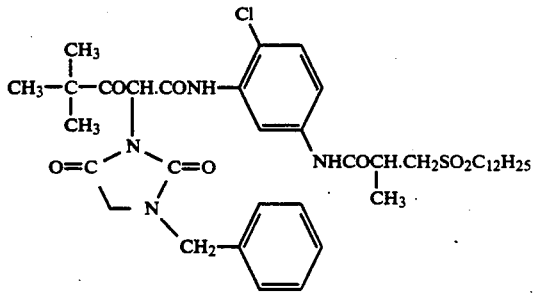

-continued (Y-8)

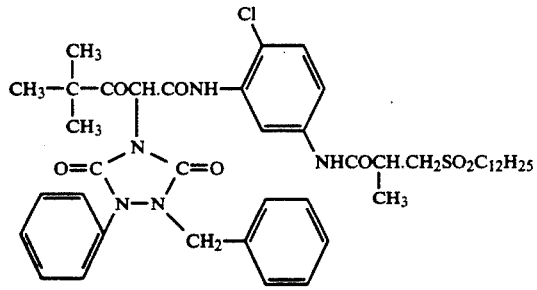

The couplers represented by the aforementioned general formulae (I) to (V) would normally be included in the silver halide emulsion layers which form the photosensitive layer at rates of from 0.1 to 1.0 mol, and preferably at rates of from 0.1 to 0.5 mol, per mol of silver halide.

Various techniques can be used for adding the aforementioned couplers to the photosensitive layers. They could be added by means of the oil in water dispersion method which is well known as the oil protection method, and after being dissolved in a solvent, the solution is emulsified and dispersed in an aqueous gelatin solution which contains a surfactant. Alternatively, water or an aqueous gelatin solution can be added to a coupler solution which contains a surfactant wherein an oil in water dispersion is formed by phase reversal. Furthermore, alkali soluble couplers can be dispersed using the so-called Fischer dispersion method. The coupler dispersions can be mixed with the photographic emulsions after removal of low boiling point organic solvents by distillation, noodle washing or ultrafiltration for example.

The use of high boiling point organic solvents which have dielectric constants (25° C.) of from 2 to 20, and refractive indices (25° C.) of from 1.3 to 1.7, and/or water insoluble polymeric compounds as coupler dispersion media are preferred.

Using high boiling point organic solvents represented by general formulae (A) - (E) indicated below are preferred.

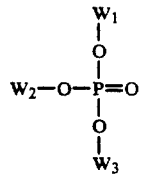

(A)

$W_1-COO-W_2$ (B)

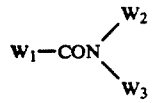

(C)

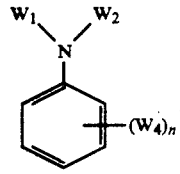

(D)

$W_1-O-W_2$ (E)

In the above formulae, $W_1$, $W_2$ and $W_3$ each represent a substituted or unsubstituted alkyl group, cycloalkyl group, alkenyl group, aryl group or heterocyclic group, $W_4$ represents $W_1$, $OW_1$ or $S-W_1$, and n represents an integer of value from 1 to 5, and when n has a value of 2 or more the $W_4$ groups may be the same or different. Moreover, $W_1$ and $W_2$ in general formula (E) may form a condensed ring.

Water immiscible compounds having a melting point below 100° C. and boiling point at least 140° C., other than those represented by general formulae (A)–(E), can be used as the high boiling point organic solvents provided that the coupler has a good solubility therein. The melting point of the high boiling point organic solvent is preferably not more. than 80° C. Moreover, the boiling point of the high boiling point organic solvent is preferably at least 160° C., and most desirably at least 170° C.

Details regarding high boiling point organic solvents can be found between the lower right column on page 137 and the upper right column on page 144 of JP-A-62-215272.

Furthermore, the couplers can be loaded onto a loadable latex polymer (see, e.g., U.S. Pat. No. 4,203,716) in the presence or absence of the aforementioned high boiling point organic solvents. They can also be dissolved in a water insoluble but organic solvent soluble polymer and then emulsified and dispersed in an aqueous hydrophilic colloid solution.

Use of the homopolymers and copolymers disclosed on pages 12–30 of the specification of International Patent WO88/00723 is preferred, particularly if the use of acrylamide based polymers is desirable for color image stabilization.

Photographic materials which have been prepared according to the present invention may contain hydroquinone derivatives, aminophenol derivatives, gallic acid derivatives and ascorbic acid derivatives as anti-color fogging agents.

Various anti-color fading agents can be used in the photographic materials of the present invention. That is, hydroquinones, 6-hydroxychromans, 5-hydroxycoumarans, spirochromans, p-alkoxyphenols, hindered phenols based on bisphenols, gallic acid derivatives, methylenedioxybenzenes, aminophenols, hindered amines, and ether and ester derivatives in which the phenolic hydroxyl groups of these compounds have been silylated or alkylated, are typical organic anti-color fading agents, which can be used for cyan, magenta and/or yellow images. Furthermore, metal complexes such as (bis-salicylaldoximato)nickel and (bis-N,N-dialkyldithiocarbamato)nickel complexes, can also be used for this purpose.

Actual examples of organic anti-color fading agents include the hydroquinones disclosed in U.S. Pat. Nos. 2,360,290, 2,418,613, 2,700,453, 2,701,197, 2,728,659, 2,732,300, 2,735,765, 3,982,944 and 4,430,425, British Patent 1,363,921, and U.S. Pat. Nos. 2,710,801 and 2,816,028; the 6-hydroxychromans, 5-hydroxychromans and spirochromans disclosed in U.S. Pat. Nos. 3,432,300, 3,573,050, 3,574,627, 3,698,909 and 3,764,337, and JP-A-52-152225; the spiroindanes disclosed in U.S. Pat. No. 4,360,589; the p-alkoxyphenols disclosed in U.S. Pat. No. 2,735,765, British Patent 2,066,975, JP-A-59-10539 and JP-B-57-19765; the hindered phenols disclosed in U.S. Pat. No. 3,700,455, JP-A-52-72224, U.S. Pat. No. 4,228,235, and JP-B-52-6623; the gallic acid derivatives, methylenedioxybenzenes and aminophenols disclosed in U.S. Pat. Nos. 3,457,079 and 4,332,886, and JP-B-56-21144 respectively; the hindered amines disclosed in U.S. Pat. Nos. 3,336,135 and 4,268,593, British Patent Nos. 1,354,313 and 1,410,846, JP-B-51-1420, JP-A-58-114036, JP-A-59-53846 and JP-A-59-78344; and the metal complexes disclosed in U.S. Pat. Nos. 4,050,938 and 4,241,155, and British Patent 2,027,731(A). These compounds can be used to achieve their intended purpose by addition to the photosensitive layer after co-emulsification with the corresponding color coupler, usually in an amount of from 5 to 100 wt.% based on the coupler.

The inclusion of ultraviolet absorbers in the cyan color forming layer, and in the layers on both sides adjacent thereto, is effective for preventing degradation of the cyan dye image by heat, and especially by light. Examples of such absorbers include benzotriazole compounds substituted with aryl groups (see, e.g., U.S. Pat. No. 3,533,794), 4-thiazolidone compounds (see e.g., U.S. Pat. Nos. 3,314,794 and 3,352,681), benzophenone compounds (see e.g., JP-A-46-2784), cinnamic acid ester compounds (see e.g., U.S. Pat. Nos. 3,705,805 and 3,707,375), butadiene compounds (see e.g., U.S. Pat. No. 4,045,229), or benzoxidol compounds (see e.g., U.S. Pat. No. 3,700,455). Ultraviolet absorbing couplers (for example, α-naphthol based cyan dye forming couplers) and ultraviolet absorbing polymers can also be used for this purpose. The ultraviolet absorbers can be mordanted in a specified layer. The aforementioned benzotriazole compounds, substituted with aryl groups, are preferred.

Using the above-described couplers with compounds such as those described below is a preferred embodiment of the present invention. The conjoint use of the compounds with pyrazoloazole couplers is especially desirable.

The use of compounds (F) which bond chemically with aromatic amine based developing agents remaining after color development processing to form compounds which are chemically inert and essentially colorless, and/or compounds (G) which bond chemically with the oxidized form of aromatic amine based color developing agents remaining after color development processing to form compounds which are chemically inert and essentially colorless either simultaneously or individually, is desirable for preventing the occurrence of staining and other side effects upon storage due to colored dye formation resulting from the reaction of couplers with color developing agents or oxidized forms thereof which remain in the film after processing, Compounds which react with p-anisidine with a second order reaction rate constant $k_2$ (measured in trioctyl phosphate at 80° C.) within the range from 1.0 liter/mol.sec to $1\times10^{-5}$ liter/mol.sec, are preferred for compound (F). The second order reaction rate constants can be measured using the method disclosed in JP-A-63-158545.

The compounds are themselves unstable if $K_2$ has a value above the aforementioned range. They will react with gelatin or water and decompose. If, on the other hand, the value of $k_2$ falls below the range, reaction with residual aromatic amine based developing agents is slow. Consequently, it is not possible to prevent the occurrence of the side effects from the residual aromatic amine based developing agents.

Preferred compounds (F) are represented by the general formulae (FI) and (FII) set forth below.

$$R_1-(A)_n-X \qquad \text{(FI)}$$

$$R_2-\underset{\underset{B}{|}}{C}=Y \qquad \text{(FII)}$$

In the above formulae, $R_1$ and $R_2$ each represent an aliphatic group, an aromatic group or a heterocyclic group. Moreover, n represents 1 or 0. A represents a group which reacts with aromatic amine based developing agents and forms a chemical bond, and X represents a group which is eliminated by reaction with an aromatic amine based developing agent. B represents a hydrogen atom, an aliphatic group, an aromatic group, a heterocyclic group, an acyl group or a sulfonyl group, and Y represents a group which accelerates the addition of the aromatic amine based developing agent to the compound of general formula (FII). Here, R and X, and Y and $R_2$ or B, can be joined together to form a cyclic structure.

Substitution reactions and addition reactions are typical of the reactions by which the residual aromatic amine based developing agents are chemically bound.

Actual examples of compounds represented by general formulae (FI) and (FII) can be found, for example, in JP-A-3-158545, JP-A-62-283338, and European Patent Publication Nos. 277,589 and 298,321 are preferred.

On the other hand, preferred compounds (G) which chemically bond with the oxidized form of the aromatic amine based developing agents which remain after color development processing and form compounds which are chemically inert and colorless, are represented by general formula (GI) below:

$$R\text{-}Z \qquad \text{(GI)}$$

In the above formula, R represents an aliphatic group, an aromatic group or a heterocyclic group. Z represents a nucleophilic group or a group which breaks down in the photographic material and releases a nucleophilic group. The compounds represented by the general formula (GI) are preferably compounds in which Z is a group of which the Pearson nucleophilicity $^{n}CH_3I$ value (R. G. Pearson et al., *J. Am. Chem. Soc.*, 90, 319 (1968)) is at least 5, or a group derived therefrom. Actual examples of compounds represented by general formula (GI) can be found in European Patent Publication Nos. 255,722, 277,589 and 298,321, JP-A-62-143048, JP-A-62-229145, JP-A-1-57259 and Japanese Patent Application No. 63-136724 preferred.

Furthermore, details of combinations of compounds (G) and compounds (F) are disclosed in European Patent Publication No. 277,589.

Water soluble dyes can be included as filter dyes, for anti-irradiation purposes or for various other purposes in hydrophilic colloid layers of the photographic materials. Dyes of this type include oxonol dyes, hemi-oxonol dyes, styryl dyes, merocyanine dyes, cyanine dyes and azo dyes. The oxonol dyes, hemi-oxonol dyes and merocyanine dyes are especially useful.

The use of Gelatin as the binding agent or protective colloid in the photosensitive layers of photographic materials of the present invention is convenient, but other hydrophilic colloids, either alone or in conjunction with gelatin, can be used for this purpose.

The gelatin used in the invention may be a lime treated gelatin, or it may be a gelatin which has been treated using acids. Details of the preparation of gelatins have been disclosed by Arthur Weise in *The Macromolecular Chemistry of Gelatin* (published by Focal Press, 1964).

Transparent films, such as cellulose nitrate films and poly(ethylene terephthalate) films, and reflective supports normally used in photographic materials, can be used for the supports used in the present invention. The use of reflective supports is preferred, The "reflective supports" have a high reflectivity and the dye image which is formed in the silver halide emulsion layer is bright. Supports which have been covered with a hydrophobic resin which contains a dispersion of a light reflecting material, such as titanium oxide, zinc oxide, calcium carbonate or calcium sulfate for increasing the reflectance in the visible wavelength region, and supports comprising a hydrophobic resin which contains a dispersion of a light reflecting substance, are included among such reflective supports. Examples of such supports include baryta paper, polyethylene coated paper, polypropylene based synthetic paper and transparent supports, such as glass plates, polyester films, such as poly(ethylene terephthalate), cellulose triacetate and cellulose nitrate films, polyamide films, polycarbonate films, polystyrene films, and vinyl chloride resins on which a reflective layer has been established or in which a reflective substance is combined. The support can be selected appropriately according to the intended application of the material.

The use of a white pigment which has been milled adequately in the presence of a surfactant and of which the surface of the pigment particles has been treated with a dihydric, trihytdric or tetrahydric alcohol, is preferred for the light reflecting substance.

The occupied surface ratio of fine white pigment particles per specified unit area (%) can be determined most typically by dividing the area under observation into adjoining $6\times6$ μm unit areas and measuring the occupied area ratio (%) ($R_i$) for the fine particles projected in each unit area. The variation coefficient of the occupied area ratio (%) can be obtained by means of the ratio $s/\bar{R}$ of the standard deviation s of $R_i$ with respect to the average value ($\bar{R}$) of $R_i$. The number of unit areas taken for observation (n) is preferably at least six. Hence, the variation coefficient can be obtained from the expression:

$$\sqrt{\frac{\sum_{i=1}^{n}(R_i - R)^2}{n-1}} \Big/ \frac{\sum_{i=1}^{n} R_i}{n}$$

In the present invention, the variation coefficient of the occupied area ratio (%) of the fine pigment particles is not more than 0.15, and preferably not more than 0.12. When this value is less than 0.08 the dispersivity of the particles in practice can be said to be uniform.

The color development baths used during development processing of the photographic materials of the invention are preferably aqueous alkaline solutions which contain a primary aromatic amine based color developing agent as the principal component. Aminophenol based compounds are useful as color developing agents, but the use of p-phenylenediamine based compounds is preferred. Typical examples of these compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, and the sulfate, hydrochloride and p-toluenesulfonate salts of these compounds. Two or more of these compounds can be used conjointly, according to the intended purpose.

Color development baths generally contain pH buffers such as alkali metal carbonates, borates or phosphates, and development inhibitors or anti-foggants such as bromides, iodides, benzimidazoles, benzothiazoles or mercapto compounds. They may also contain, as required, various preservatives such as hydroxylamine, diethylhydroxylamine, sulfites, hydrazines, phenylsemicarbazides, triethanolamines, catecholsulfonic acids and triethylenediamine(1,4-diazabicyclo[2,2,2]octane) compounds, organic solvents such as ethylene glycol and diethylene glycol, development accelerators such as benzyl alcohol, polyethylene glycol, quaternary ammonium salts and amines, color forming couplers, competitive couplers, fogging agents such as sodium borohydride, auxiliary developing agents such as 1-phenyl-3-pyrazolidone, viscosity imparting agents, various chelating agents as typified by the aminopolycarboxylic acids, aminopolyphosphonic acids, alkylphosphonic acids and phosphonocarboxylic acids, examples of which include ethylenediamine tetra-acetic acid, nitrilotriacetic acid, diethylenetriamine penta-acetic acid, cyclohexanediamine tetra-acetic acid, hydroxyethyliminodiacetic acid, 1-hydroxyethylidene-1,1-diphosphonic acid, nitrilo-N,N,N-trimethylenephosphonic acid, ethylenediamine-N,N,N',N'-tetramethylenephosphonic acid, ethylenediamine-di(o-hydroxyphenylacetic acid) and salts of these acids.

Color development is carried out after a normal black and white development in cases where reversal processing is carried out. The known black and white developers, for example dihydroxybenzenes such as hydroquinone, 3-pyrazolidones such as 1-phenyl-3-pyrazolidone or aminophenols such as N-methyl-p-aminophenol, can be used individually, or in combination, in the black and white development bath.

The pH of the color development baths and black and white development bath is generally within the range from 9 to 12. The replenishment amounts of the development baths depend on the color photographic material which is being processed, but it is generally less than 3 liters per square meter of photographic material. Replenishment amounts of less than 500 ml per square meter of photographic material can be achieved by reducing the bromide ion concentration in the replenisher. The prevention of evaporation or aerial oxidation of the liquid by minimizing the area of contact between the processing bath and the atmosphere is desirable in those cases in which the rate of replenishment is low.

Furthermore, the replenishment amount can be reduced by using some means of suppressing the accumulation of bromide ion in the development bath.

The photographic emulsion layer is subjected to a normal bleaching process after color development. The bleaching process may be carried out at the same time as a fixing process (a bleach-fix process) or it may be carried out as a separate process. Moreover, processing methods in which a bleach-fix process is carried out after a bleaching process, can be used in order to speed up processing. Moreover, processing can be carried out in two connected bleach-fix baths; a fixing process can be carried out before a bleach-fixing process, or a bleaching process can be carried out after a bleach-fix process. Compounds of multivalent metals, such as iron(III), cobalt (III), chromium(VI) and copper(II), peracids, quinones and nitro compounds, for example, can be used as bleaching agents. Typical bleaching agents include ferricyanides; dichromates; organic complex salts of iron(III) or cobalt(III) such as complex salts with aminopolycarboxylic acids (e.g., ethylenediamine tetra-acetic acid, diethylenetriamine penta-acetic acid, cyclohexanediamine tetra-acetic acid, methylimino diacetic acid, 1,3-diaminopropane tetra-acetic acid and glycol ether diamine tetra-acetic acid) with citric acid, tartaric acid or malic acid; persulfates; permanganates; and nitrobenzenes. From among these materials, the use of the polyaminocarboxylic acid iron(III) complex salts, principally ethylenediamine tetra-acetic acid iron(III) complex salts, and persulfates, is preferred because they provide rapid processing and the prevention of environmental pollution. Moreover, the aminopolycarboxylic acid iron(III) complex salts are especially useful in both bleach baths and bleach-fix baths. The pH of the bleach baths and bleach-fix baths in which these aminopolycarboxylic acid iron(III) salts are used is normally from 5.5 to 8, but lower pH values can be used in order to speed up processing.

Bleaching accelerators can be used, as required, in the bleach baths, bleach-fix baths or bleach or bleach-fix pre-baths. Actual examples of useful bleach accelerators have been disclosed in the following documents. There are the compounds which have a mercapto group or a disulfide bond disclosed in U.S. Pat. No. 3,893,858, West German Patent 1,290,812, JP-A-53-95630, and *Research Disclosure* No. 17129 (July 1978); thiazolidine derivatives disclosed in JP-A-50-140129; thiourea derivatives disclosed in U.S. Pat. No. 3,706,561; iodides disclosed in JP-A-58-16235; polyoxyethylene compounds disclosed in West German Patent No. 2,748,430; polyamine compounds disclosed in JP-B-45-8836; and bromide ion. From among these compounds, those which have a mercapto group or a disulfide group are, preferred due to their large accelerating effect. The compounds disclosed in U.S. Pat. No. 3,893,858, West German Patent No. 1,290,812 and JP-A-53-95630 are especially desirable. Moreover, the compounds disclosed in U.S. Pat. No. 4,552,834 are also desirable. Bleach accelerators may also be included in photographic materials. The bleach accelerators are especially effective when bleach-fixing color photographic picture-taking materials.

Thiosulfates, thiocyanates, thioether based compounds, thioureas and large amounts of iodide can be used as fixing agents, but thiosulfates are normally used. Ammonium thiosulfate can be used in the widest range of applications. Sulfites and bisulfites, or carbonyl/bisulfite addition compounds, are the preferred preservatives for bleach-fix baths.

The silver halide color photographic materials of the invention are usually subjected to a water washing process and/or stabilization process after de-silvering. The amount of wash water used in washing can be fixed within a wide range, depending on the application and the nature (e.g., materials in which couplers which have been used) of the photographic material, the wash water temperature, the number of water washing tanks (the number of water washing stages), the replenishment system (i.e., whether a counter flow or a sequential flow system is used), and various other conditions. The relationship between the amount of water used and the number of washing tanks in a multi-stage counter-flow system can be obtained using the method set forth on pages 248–253 of the *Journal of the Society of Motion Picture and Television Engineers*, Vol. 64 (May 1955).

The amount of wash water can be greatly reduced by using the multi-stage counter-flow system described in the aforementioned literature, but bacteria proliferate due to the increased residence time of the water in the tanks. Problems arise with the suspended matter, which is produced, becoming attached to the photographic material. A method in which calcium ion and magnesium ion concentrations are reduced is very effective as a means of overcoming this problem when processing the color photographic materials of the present invention (see JP-A-62-288838). Furthermore, the isothiazolone compounds and thiabendazoles disclosed in JP-A-57-8542, chlorine based disinfectants such as chlorinated sodium isocyanurate, and benzotriazole, and the disinfectants disclosed in "*The Chemistry of Biocides and Fungicides*" by Horiguchi, in "Killing Micro-organisms, Biocidal and Fungicidal Techniques" published by the Health and Hygiene Technical Society, and in "*A Dictionary of Biocides and Funcicides*" published by the Japanese Biocide and Fungicide Society, can also be used in this regard.

The pH value of the wash water used for processing the photographic materials of the invention is from 4 to 9, and preferably from 5 to 8. The washing water temperature and the washing time can be set variously in accordance with the nature and application of the photographic material. In general, however, washing conditions of from 20 seconds to 10 minutes at a temperature of from 15° C. to 45° C., preferably of from 30 seconds to 5 minutes at a temperature of from 25° C. to 40° C., are used. Moreover, the photographic materials of this invention can be processed directly in a stabilizing bath instead of being subjected to a water wash as described above. The known methods disclosed in JP-A-57-8543, JP-A-58-14834 and JP-A-60-220345 can be used for this purpose.

In some cases a stabilization process can be carried out following the aforementioned water washing process. Stabilizing baths which contain formalin and surfactant which are used as final baths with color camera photographic materials are an example of such a process. Various chelating agents and fungicides ca also be added to these stabilizing baths.

The overflow which accompanies replenishment of the above mentioned water washing or stabilizing baths, can be reused in other operations such as the de-silvering process.

Color developing agents can be incorporated into the silver halide color photographic material of the invention in order to simplify and speed up processing. The incorporation of various color developing agent precursors is preferred. Examples include the indoaniline based compounds disclosed in U.S. Pat. No. 3,342,597, the Shiff's base-type compounds disclosed in U.S. Pat. No. 3,342,599, *Research Disclosure* No. 14850 and *ibid*, No. 15159, the aldol compounds disclosed in *Research Disclosure* No. 13924, the metal complex salts disclosed in U.S. Pat. No. 3,719,492 and the urethane based compounds disclosed in JP-A-53-135628.

Various 1-phenyl-3-pyrazolidones can be incorporated, as required, into the silver halide color photographic materials of the invention with a view to accelerating color development. Typical compounds of this type have been disclosed, for example, in JP-A-56-64339, JP-A-57-144547 and JP-A-58-115438.

The various processing baths are used at temperatures ranging from 10° C. to 50° C. The standard temperature is normally from 33° C. to 38° C., but accelerated processing and shorter processing times can be realized at higher temperatures. On the other hand, increased picture quality and better processing bath stability can be achieved at lower temperatures. Furthermore, processes using hydrogen peroxide intensification or cobalt intensification such as those disclosed in West German Patent No. 2,226,770 or U.S. Pat. No. 3,674,499 can be used in order to economize on silver in the photographic material.

In the interest of brevity and conciseness, the contents of the aforementioned numerous patents and articles are hereby incorporated by reference.

The invention is described in detail below by means of illustrative examples, but the invention is in no way intended to be limited by these embodiments of the invention.

EXAMPLE 1

A silver chlorobromide emulsion (i), which had not been chemically sensitized, was prepared in the way outlined below.

| | |
|---|---|
| First Liquid | |
| $H_2O$ | 1000 cc |
| NaCl | 7.1 grams |
| KBr | 0.4 gram |
| Gelatin | 32.0 grams |
| Second Liquid | |
| The compound indicated below (1 w % aq. soln.) | 3.8 cc |

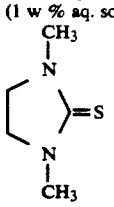

| | |
|---|---|
| Third Liquid | |
| KBr | 63.2 grams |
| NaCl | 10.5 grams |
| $H_2O$ to make up to | 600.0 cc |
| Fourth Liquid | |
| $AgNO_3$ | 120.0 grams |

-continued

| | |
|---|---|
| $NH_4NO_3$ (50 w % aq. soln.) | 1.5 cc |
| $H_2O$ to make up to | 540.0 cc |
| Fifth Liquid | |
| KBr | 19.3 grams |
| NaCl | 7.5 grams |
| $K_2IrCl_6$ (0.001 w % aq. soln.) | 17.8 cc |
| $H_2O$ to make up to | 250.0 cc |
| Sixth Liquid | |
| $AgNO_3$ | 40 grams |
| $NH_4NO_3$ (50 w % aq. soln.) | 0.5 cc |
| $H_2O$ to make up to | 240 cc |

The first liquid was heated to 63° C. and the second liquid was added. Next, the third and fourth liquids were added simultaneously over a period of 40 minutes. After a further period of 10 minutes, the fifth liquid was added over a period of 15.5 minutes and the sixth liquid was added over a period of 12.5 minutes, the two additions being started simultaneously. The temperature was lowered five minutes after the addition had been completed and the mixture was desalted. Water and dispersed gelatin were then added, the pH was adjusted to 6.40 and the mono-disperse cubic silver chlorobromide emulsion (i) of average grain size 0.48 μm, of variation coefficient (the value obtained by dividing the standard deviation by the average grain size, $s/\bar{d}$) 0.10, and silver bromide content of 74 mol.%, was obtained.

Next, the emulsion (ii), which had not been chemically sensitized, was obtained in the same way as emulsion (i) except that the time for the addition of the fifth liquid was changed to 12.5 minutes.

Next, the emulsion (iii), which had not been chemically sensitized, was obtained in the same way as emulsion (i) except that the KBr and NaCl contents of the third liquid were changed to 58.5 grams and 12.9 grams, respectively, and the KBr and NaCl contents of the fifth liquid were changed to 24.1 grams and 5.1 grams, respectively.

Next, emulsion (iv), which had not been chemically sensitized, was obtained in the same way as emulsion (i), except that the KBr and NaCl contents of the third liquid were changed to 44.8 grams and 5.7 grams, respectively, the $AgNO_3$ content of the fourth liquid was changed to 80 grams, the KBr and NaCl contents of the fifth liquid were changed to 37.7 grams and 11.8 grams, respectively, and the $AgNO_3$ content of the sixth liquid was changed to 80 grams.

Moreover, the average grain sizes, variation coefficients and silver bromide contents of emulsions (ii) to (iv) were the same as those of emulsion (i).

Emulsions (i) to (iv), which had not been chemically sensitized, were then chemically sensitized with triethylthiourea in the presence of the types and quantities of nucleic acids and under the pAg conditions shown in Table 1. The temperature was set at 58° C. and the time was selected so as to provide the maximum photographic speed under the various conditions. Furthermore, in Table 1 a ribonucleic acid (trade name "RNA-F", made by the Sanyo Kokusai Pulp Co.) was used for nucleic acid (a) and adenine was used for nucleic acid (b).

TABLE 1

| Emulsion | Emulsion which had not been chemically Sensitized | Chemical Sensitization Conditions: Nucleic Acid | Amount Added | pAg | Remarks |
|---|---|---|---|---|---|
| A | (i) | (a) | 300 mg/mol.Ag | 6.3 | Comparative Ex. |
| B | (i) | (a) | 300 mg/mol.Ag | 6.5 | This Invention |

TABLE 1-continued

| Emulsion | Emulsion which had not been chemically Sensitized | Chemical Sensitization Conditions Nucleic Acid | Amount Added | pAg | Remarks |
|---|---|---|---|---|---|
| C | (i) | (a) | 300 mg/mol.Ag | 6.9 | This Invention |
| D | (i) | (a) | 300 mg/mol.Ag | 7.3 | This Invention |
| E | (i) | (a) | 300 mg/mol.Ag | 7.5 | This Invention |
| F | (i) | (a) | 300 mg/mol.Ag | 7.7 | Comparative Ex. |
| G | (i) | (b) | 140 mg/mol.Ag | 7.3 | This Invention |
| H | (i) | — | — | 6.3 | Comparative Ex. |
| I | (i) | — | — | 7.3 | Comparative Ex. |
| J | (i) | — | — | 7.7 | Comparative Ex. |
| K | (ii) | (a) | 300 mg/mol.Ag | 7.3 | Comparative Ex. |
| L | (iii) | (a) | 300 mg/mol.Ag | 7.3 | Comparative Ex. |
| M | (iv) | (a) | 300 mg/mol.Ag | 7.3 | This Invention |

Note:
Emulsion (i): Core/shell conversion emulsion
Emulsion (iv): Core/shell conversion emulsion
Emulsion (ii): Core/shell emulsion (no conversion)
Emulsion (iii): Conversion emulsion (not a core/shell emulsion)

The thirteen types of emulsion A - M were coated on a cellulose triacetate base in such a way as to provide coated silver weights of 3.5 g/m$^2$ and coated gelatin weights of 5 g/m$^2$. These samples were exposed for 1 second to white light of color temperature 5400 K through an optical wedge and then they were developed and processed in the way indicated below. The photographic densities were measured using a densitometer and the results obtained are shown in Table 2.

| Process | Temperature | Time |
|---|---|---|
| Development | 20° C. | 10 minutes |
| Fixing | 20° C. | 3 minutes |
| Water Wash | 20° C. | 5 minutes |
| Development Bath | | |
| Ascorbic acid | | 10 grams |
| p-Methylaminophenol | | 2.4 grams |
| Sodium carbonate | | 10 grams |
| Potassium bromide | | 1 gram |
| Water | to make up to 1 liter | |
| Fixer Bath | | |
| Sodium thiosulfate | | 300 grams |
| Anhydrous sodium sulfite | | 15 grams |
| Glacial acetic acid | | 12 grams |
| Water | to make up to 1 liter | |

In Table 2, photographic speed is represented by the reciprocal of the exposure required to provide an optical density of 0.4 above the fog density. It is indicated as a relative value taking the speed for emulsion A to be 100. Furthermore, the gradation is represented by the difference between the logarithm of the exposure required to provide an optical density of 0.4 above the fog density, and the logarithm of the exposure required to provide an optical density of 0.04 above the fog density.

TABLE 2

| Emulsion | Results Photographic Speed | Gradation | Fog | Remarks |
|---|---|---|---|---|
| A | 100 (Standard) | 0.27 | 0.06 | Comp. Ex. |
| B | 115 | 0.26 | 0.03 | Invention |
| C | 118 | 0.25 | 0.02 | Invention |
| D | 120 | 0.25 | 0.02 | Invention |
| E | 116 | 0.27 | 0.02 | Invention |
| F | 103 | 0.33 | 0.02 | Comp. Ex. |
| G | 120 | 0.25 | 0.02 | Invention |
| H | 88 | 0.38 | 0.09 | Comp Ex. |
| I | 95 | 0.35 | 0.06 | Comp. Ex. |
| J | 101 | 0.33 | 0.03 | Comp. Ex. |

TABLE 2-continued

| Emulsion | Results Photographic Speed | Gradation | Fog | Remarks |
|---|---|---|---|---|
| K | 45 | 0.42 | 0.02 | Comp. Ex. |
| L | 75 | 0.36 | 0.02 | Comp. Ex. |
| M | 105 | 0.28 | 0.02 | Invention |

A lower value for the gradation indicated a higher contrast.

It is clear from Table 2 that Emulsions B–E, G and M representing the present invention provided high contrast and were less susceptible to fogging than in the past as a result of being chemically sensitized under conditions of pAg 6.5–7.5 in the presence of a nucleic acid. Furthermore, a comparison of Emulsion M with Emulsions K and L, confirms the superiority of the emulsions which had a layer structure and which the surface had been subjected to halogen conversion, was confirmed.

EXAMPLE 2

Multi-layer color print materials having a particular layer structure were prepared on paper supports which had been laminated on both sides with polyethylene.

Layer Structure

The compositions of each layer is indicated below. The numerical values indicate the coated weights (g/m$^2$). However, in the case of the silver halide emulsions, the coated weight shown is the coated weight calculated as silver.

Support

Polyethylene laminated paper wherein white pigment ($TiO_2$) and blue dye (ultramarine) were included in the polyethylene on the first layer side.

| First Layer (Blue Sensitive Silver Halide Emulsion Layer) | |
|---|---|
| Mono-disperse silver chlorobromide emulsion (EM-1) to which the spectral sensitizing agent (Sen-1) had been added | 0.09 |
| Mono-disperse silver chlorobromide emulsion (EM-2) to which the spectral sensitizing agent (Sen-1) had been added | 0.21 |
| Anti-foggant (Cpd-1) | 0.004 |
| Gelatin | 1.28 |
| Yellow coupler (ExY) | 0.68 |
| Anti-foggant (Cpd-2) | 0.006 |
| Colored image stabilizer (Cpd-3) | 0.07 |

-continued

| | |
|---|---|
| Solvent (a 1:1 mixture (by volume) of Solv-1 and Solv-2) | 0.24 |
| **Second Layer (Anti-color Mixing Layer)** | |
| Gelatin | 1.34 |
| Anti-color mixing agent (Cpd-4) | 0.04 |
| Solvent (a 1:1 mixture (by volume) of solve-3 and Solv-4) | 0.20 |
| **Third Layer (Green Sensitive Silver Halide Emulsion Layer)** | |
| Mono-disperse silver chlorobromide emulsion (EM-3) to which the spectral sensitizing agents (Sen-2,3) had been added | 0.075 |
| Mono-disperse silver chlorobromide emulsion (EM-4) to which the spectral sensitizing agents (Sen-2,3) had been added | 0.05 |
| Anti-foggant (Cpd-1) | 0.002 |
| Anti-foggant (Cpd-5) | 0.001 |
| Gelatin | 1.47 |
| Magenta coupler (ExM) | 0.32 |
| Colored image stabilizer (Cpd-6) | 0.10 |
| Colored image stabilizer (Cpd-7) | 0.08 |
| Colored image stabilizer (Cpd-8) | 0.03 |
| Colored image stabilizer (Cpd-9) | 0.004 |
| Solvent (a 1:2 mixture (by volume) of Solv-3 and Solv-5) | 0.65 |
| **Fourth Layer (Ultraviolet Absorbing Layer)** | |
| Gelatin | 1.43 |
| Ultraviolet absorber (UV-1/2/3 in mol ratio 1:4:4) | 0.47 |
| Anti-color mixing agent (Cpd-4) | 0.05 |
| Solvent (Solv-6) | 0.24 |
| **Fifth Layer (Red Sensitive Silver Halide Emulsion Layer)** | |
| Mono-disperse silver chlorobromide emulsion to which the spectral sensitizing agents (Sen-4,5) had been added | 0.20 |

-continued

| | |
|---|---|
| Anti-foggant (Cpd-2) | 0.008 |
| Anti-foggant (Cpd-10) | 0.0001 |
| Anti-foggant (Cpd-11) | 0.0001 |
| Gelatin | 0.85 |
| Cyan coupler (ExC-1) | 0.13 |
| Cyan coupler (ExC-2) | 0.15 |
| Colored image stabilizer (UV-1/3/4 in mol ratio 1:3:3) | 0.067 |
| Colored image stabilizer (Cpd-3) | 0.25 |
| Colored image stabilizer (Cpd-7) | 0.004 |
| Colored image stabilizer (Cpd-8) | 0.007 |
| Solvent (Solv-1) | 0.16 |
| **Sixth Layer (Ultraviolet Absorbing Layer)** | |
| Gelatin | 0.38 |
| Ultraviolet absorber (UV-1/2/3 in mol ratio 1:4:4) | 0.13 |
| Solvent (Solv-6) | 0.06 |
| **Seventh Layer (Protective Layer)** | |
| Gelatin | 1.25 |
| Acrylic modified poly(vinyl alcohol) (17% modification) | 0.05 |
| Liquid paraffin | 0.02 |

Details of the silver halide emulsions used in the above mentioned samples are shown in Table 3.

Table 3

| Emulsion | Form | Average Grain Size (μm) | Br Content (mol. %) | Variation Coefficient |
|---|---|---|---|---|
| EM-1 | Cubic | 0.88 | 79 | 0.06 |
| EM-2 | Cubic | 0.65 | 80 | 0.06 |
| EM-3 | Cubic | 0.46 | 90 | 0.09 |
| EM-4 | Cubic | 0.35 | 90 | 0.09 |

Variation Coefficient = Standard Deviation/Average Grain Size (Sen-1) $3.8 \times 10^{-4}$ mol/mol.Ag

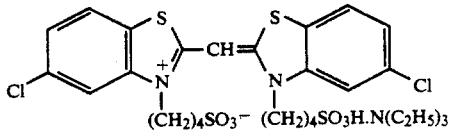

(Sen-2) $2.1 \times 10^{-4}$ mol/mol.Ag

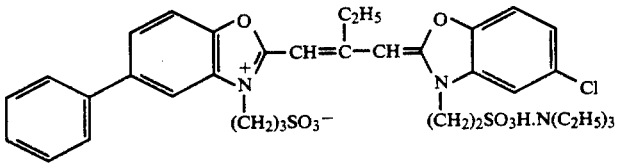

(Sen-3) $4.2 \times 10^{-5}$ mol/mol.Ag

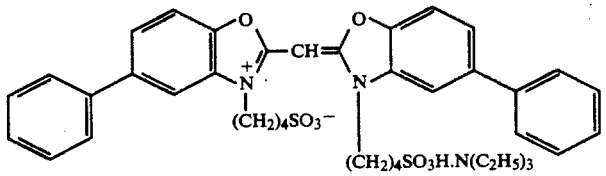

(Sen-4) $6.1 \times 10^{-5}$ mol/mol.Ag

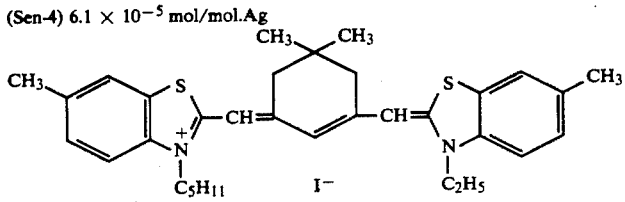

-continued
(Sen-5) 2.3 × $10^{-3}$ mol/mol.Ag
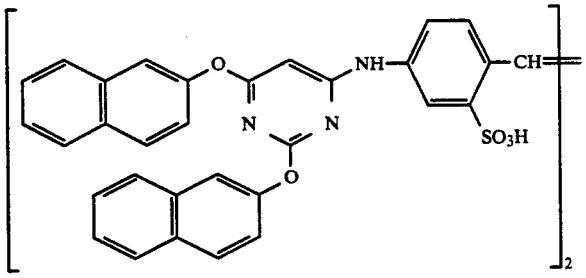
(ExY)
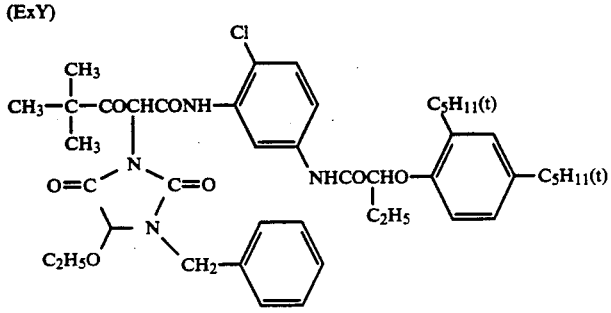
(ExM)
A 1:1 mixture (mol ratio) of:
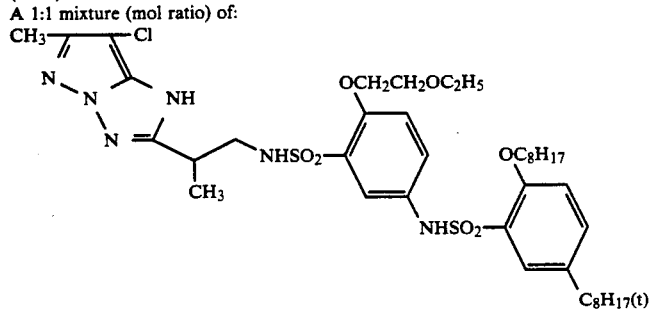
and
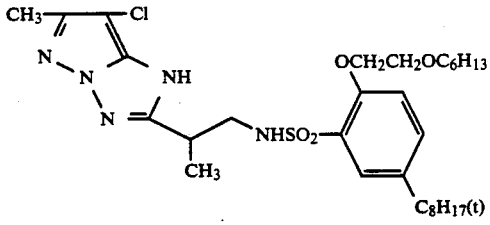
(ExC-1)
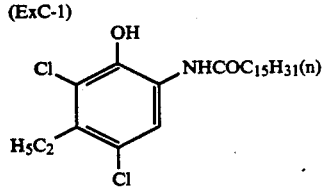
(ExC-2)
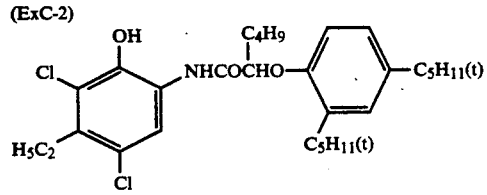

-continued
(Cpd-1)
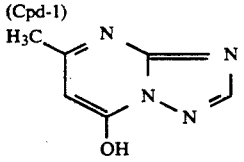
(Cpd-2)
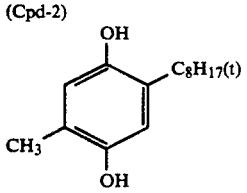
(Cpd-3)
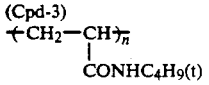
Moleuclar Weight About 60,000
(Cpd-4)
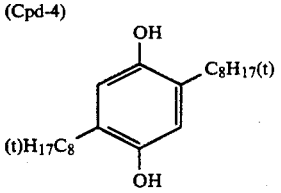
(Cpd-5)
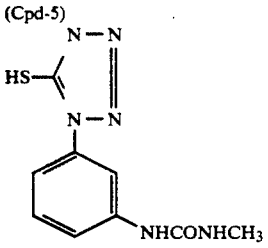
(Cpd-6)
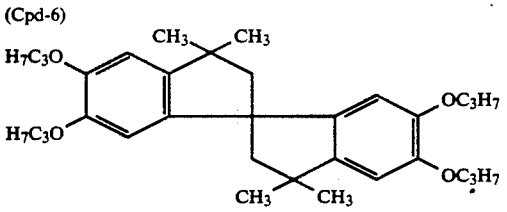
(Cpd-7)
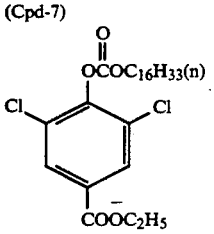

-continued
(Cpd-8)
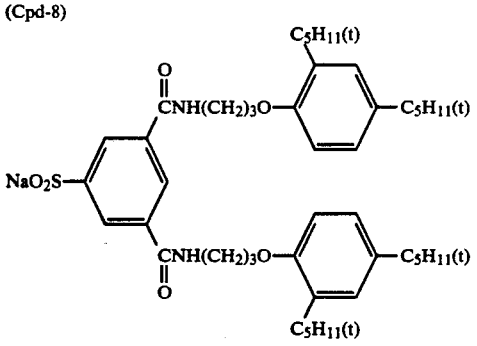
(Cpd-9) Colored Image Stabilizer
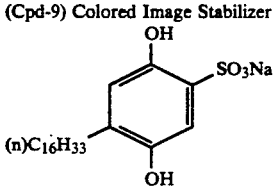
(Cpd-10)
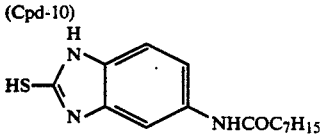
(Cpd-11)
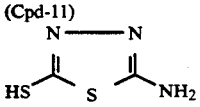
(UV-1)
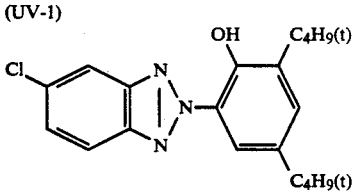
(UV-2)
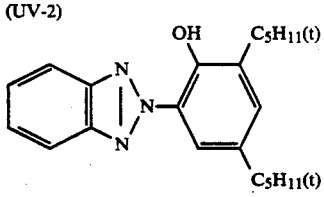
(UV-3)
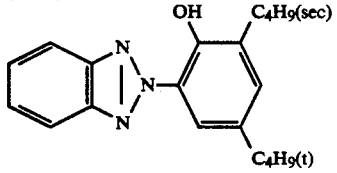
(UV-4)
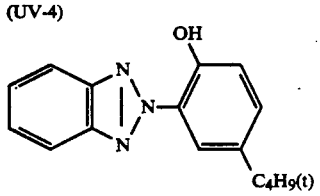

-continued (Solv-1)

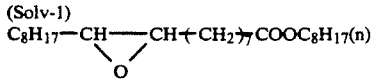

(Solv-2)

$O{=}P(OC_9H_{19}(iso))_3$ (Solv-3)

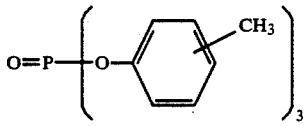

(Solv-4)

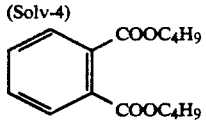

(Solv-5) Solvent

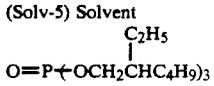

(Solv-6) Solvent

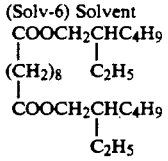

1-Oxy-3,5-dichloro-s-triazine, sodium salt was, used as a gelatin hardening agent in each layer. Furthermore, the dyes indicated below were used as anti-irradiation dyes.

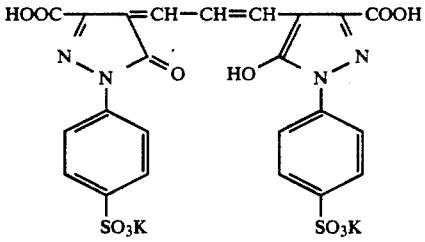

and

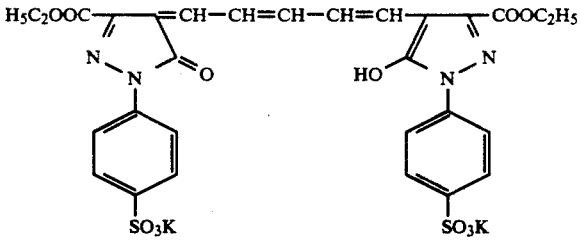

Samples 201 to 213 were prepared on the basis of the layer structure described above by altering the emulsion in the fifth layer using the emulsions A–M used in Example 1.

The samples described above were subjected to a graded exposure as used for sensitometric purposes through tri-color separation filters using a sensitometer (a model FWH sensitometer, made by the Fuji Photo Film Co., with a light source of color temperature 3200 K).

The exposure at this time was such as to provide a 250 CMS exposure at an exposure time of 0.1 second. After exposure, the samples were processed according to the processing operations indicated below.

| Process | Temperature | Time |
|---|---|---|
| Color Development | 33° C. | 3 min. 30 sec. |
| Bleach-fix | 33° C. | 1 min. 30 sec. |
| Water Wash (1) | 30–34° C. | 60 seconds |
| Water Wash (2) | 30–34° C. | 60 seconds |
| Water Wash (3) | 30–34° C. | 60 seconds |

-continued

| Process | Temperature | Time |
|---|---|---|
| Drying | 70–80° C. | 50 seconds |

(A three tank counter-flow system water wash (3)→(1))

The composition of each processing bath is indicated below.

| | |
|---|---|
| Color Development Bath | |
| Water | 800 ml |
| Diethylenetriamine penta-acetic acid | 1.0 gram |
| Nitrilotriacetic acid | 1.5 grams |
| Benzyl alcohol | 15 ml |
| Diethylene glycol | 10 ml |
| Sodium sulfite | 2.0 grams |
| Potassium bromide | 0.5 gram |
| Potassium carbonate | 30 grams |
| N-Ethyl-N-(β-methanesulfonamido-ethyl)-3-methyl-4-aminoaniline sulfate | 5.0 grams |
| Hydroxylamine hydrochloride | 4.0 grams |
| Fluorescent whitener (Whitex 4B, made by Sumitomo Chemicals) | 1.0 gram |
| Water | to make up to 1000 ml |
| pH (25° C.) | 10.20 |
| Bleach-fix Bath | |
| Water | 400 ml |
| Ammonium thiosulfate (70 w % aq. soln.) | 150 ml |
| Sodium sulfite | 18 grams |
| Ethylenediamine tetra-acetic acid, iron(III) ammonium salt | 55 grams |
| Ethylenediamine tetra-acetic acid, disodium salt | 5 grams |
| Water | to make up to 1000 ml |
| pH (25° C.) | 6.70 |

The results obtained on measuring the cyan densities with a red filter are shown in Table 4. The photographic speed is represented by the reciprocal of the exposure required to provide an optical density of 1.0 above the fog density and shown as a relative value obtained by taking the speed of sample 201 to be 100. Furthermore, the gradation is represented by the difference between the logarithms of the exposures required to provide optical densities of 1.0 and 0.2 above the fog density.

TABLE 4

| Sample Number | Results: Photographic Speed | Gradation | Fog | Remarks |
|---|---|---|---|---|
| 201 | 100 (Standard) | 0.31 | 0.18 | Comp. Ex. |
| 202 | 117 | 0.30 | 0.12 | Invention |
| 203 | 120 | 0.29 | 0.10 | Invention |
| 204 | 122 | 0.29 | 0.10 | Invention |
| 205 | 118 | 0.31 | 0.10 | Invention |
| 206 | 105 | 0.38 | 0.10 | Comp. Ex. |
| 207 | 122 | 0.29 | 0.10 | Invention |
| 208 | 90 | 0.44 | 0.24 | Comp Ex. |
| 209 | 97 | 0.40 | 0.18 | Comp. Ex. |
| 210 | 103 | 0.38 | 0.12 | Comp. Ex. |
| 211 | 46 | 0.48 | 0.10 | Comp. Ex. |
| 212 | 77 | 0.41 | 0.10 | Comp. Ex. |
| 213 | 107 | 0.32 | 0.10 | Invention |

It can be seen from Table 4 that Samples 202 - 205, 207 and 213 representing the invention had high contrast and high speed and low fog levels.

EXAMPLE 3

The Samples described in Example 2 were evaluated in the same way as before, but using the development processing conditions indicated below.

| Process | Temperature | Time |
|---|---|---|
| Color Development | 37° C. | 3 min. 30 sec. |
| Bleach-fix | 33° C. | 1 min. 30 sec. |
| Water Wash (1) | 30–34° C. | 60 seconds |
| Water Wash (2) | 30–34° C. | 60 seconds |
| Water Wash (3) | 30–34° C. | 60 seconds |
| Drying | 70–80° C. | 60 seconds |

(A three tank counter-flow system water wash (3)→(1))

The composition of each processing bath is indicated below.

| | |
|---|---|
| Color Developoment Bath | |
| Water | 800 ml |
| Diethylenetriamine penta-acetic acid | 1.0 gram |
| Nitrilotriacetic acid | 2.0 grams |
| Benzyl alcohol | 15 ml |
| Diethylene glycol | 10 ml |
| Sodium sulfite | 2.0 grams |
| Potassium bromide | 1.0 gram |
| Potassium carbonate | 30 grams |
| N-Ethyl-N-(β-methanesulfonamido-ethyl)-3-methyl-4-aminoaniline sulfate | 4.5 grams |
| Hydroxylamine sulfate | 3.0 grams |
| Fluorescent whitener (Whitex 4B, made by Sumitomo Chemicals) | 1.0 gram |
| Water | to make up to 1000 ml |
| pH (25° C.) | 10.25 |
| Bleach-fix Bath | |
| Water | 400 ml |
| Ammonium thiosulfate (70 w % aq. soln.) | 150 ml |
| Sodium sulfite | 18 grams |
| Ethylenediamine tetra-acetic acid, iron(III) ammonium salt | 55 grams |
| Ethylenediamine tetra-acetic acid, disodium salt | 5 grams |
| Water | to make up to 1000 ml |
| pH (25° C.) | 6.70 |

The results obtained were the same as those shown in Table 4, and the superiority of the samples representing the invention was confirmed.

EXAMPLE 4

The samples described in Example 2 were evaluated in the same way as before but using the development processing conditions indicated below. The results were the same as those shown in Table 4.

| Process | Temperature | Time |
|---|---|---|
| Color Development | 38° C. | 1 min. 40 sec. |
| Bleach-fix | 35° C. | 60 seconds |
| Rinse (1) | 33–35° C. | 20 seconds |
| Rinse (2) | 33–35° C. | 20 seconds |
| Rinse (3) | 33–35° C. | 20 seconds |
| Drying | 70–80° C. | 50 seconds |

| | |
|---|---|
| Color Development Bath | |
| Water | 800 ml |
| Diethylenetriamine penta-acetic | 1.0 gram |

-continued

| | |
|---|---|
| acid | |
| Nitrilotriacetic acid | 2.0 grams |
| 1-Hydroxyethylidene-1,1-diphosphonic acid | 2.0 grams |
| Benzyl alcohol | 16 ml |
| Diethylene glycol | 10 ml |
| Sodium sulfite | 2.0 grams |
| Potassium bromide | 0.5 gram |
| Potassium carbonate | 30 grams |
| N-Ethyl-N-(β-methanesulfonamidoethyl-3-methyl-4-aminoaniline sulfate | 5.5 grams |
| Hydroxylamine sulfate | 2.0 grams |
| Fluorescent whitener (Whitex 4B, made by Sumitomo Chemicals) | 1.5 gram |
| Water | to make up to 1000 ml |
| pH (25° C.) | 10.20 |
| Bleach-fix Bath | |
| Water | 400 ml |
| Ammonium thiosulfate (70 w % aq. soln.) | 80 ml |
| Sodium sulfite | 24 grams |
| Ethylenediamine tetra-acetic acid, iron(III) ammonium salt | 30 grams |
| Ethylenediamine tetra-acetic acid, disodium salt | 5 grams |
| Water | to make up to 1000 ml |
| pH (25° C.) | 6.50 |

Rinse Bath

Ion exchanged water (Calcium and magnesium both less than 3 ppm.)

EXAMPLE 5

A comparison was made using emulsions A - M for the third layer (green sensitive emulsion layer) emulsion in the photographic materials of Example 2. Similar results to those obtained in Example 2 were obtained for the magenta densities.

EXAMPLE 6

A comparison was made using emulsions A-M for the first layer (blue sensitive emulsion layer) emulsions in the photographic materials of Example 2. Similar results to those obtained in Example 2 were obtained for the yellow densities.

It can be seen from the results of the illustrative examples described above that it is possible to provide, by means of the present invention, silver halide photographic materials which have a high speed and a photographic performance which provides a high contrast and a low fog level.

While the invention has been described in detail and with reference to specific embodiments thereof, it will be apparent to one skilled in the art that various changes and modifications can be made therein without departing from the spirit and scope thereof.

What is claimed is:

1. A method for producing a silver halide photographic material comprising chemically sensitizing desalted silver chlorobromide grains in the presence of a nucleic acid or degradation product thereof at a pAg value ranging from about 6.5 to 7.5, said silver chlorobromide grains having been obtained by subjecting the surface of silver halide grains to halogen conversion, which silver halide grains are essentially silver iodide free and have a plurality of phases of which the halogen compositions substantially differ from each other.

2. The method for producing a silver halide photographic material according to claim 1, wherein the silver iodide content of the silver chlorobromide grains is not more than 0.5 mol%.

3. The method for producing a silver halide photographic material according to claim 2, wherein the silver chlorobromide grains contain no silver iodide.

4. The method for producing a silver halide photographic material according to claim 1, wherein the silver bromide content of the silver chlorobromide emulsion ranges from at least 0.5 mol% to about 90 mol%.

5. The method for producing a silver halide photographic material according to claim 4, wherein the silver bromide content is at least 60 mol%.

6. The method for producing a silver halide photographic material according to claim 1, wherein the grains of the silver chlorobromide emulsion have a structure of at least three parts, the silver bromide contents of which substantially differ from each other.

7. The method for producing a silver halide photographic material according to claim 6, wherein the silver chlorobromide grains having a structure of at least three parts are obtained by subjecting the surface of silver halide grains to halogen conversion, which silver halide grains are essentially silver iodide free and have a core/shell structure, the silver bromide contents of which core and shell differ by at least 10 mol% from each other.

8. The method for producing a silver halide photographic material according to claim 7, wherein the core/shell structure is a multilayer core/shell structure having a different silver bromide contents by at least 10 mol% from each other.

9. The method for producing a silver halide photographic material according to claim 7, wherein the silver bromide contents differ from 15 mol% to 35 mol%.

10. The method for producing a silver halide photographic material according to claim 1, wherein the extent of halogen conversion ranges from 0.5 mol% to 20 mol%.

11. The method for producing a silver halide photographic material according to claim 10, wherein the extent of halogen conversion ranges from 1 mol% to 15 mol%.

12. The method for producing a silver halide photographic material according to claim 1, wherein the silver halide emulsion has been subjected to sulfur sensitization.

13. The method for producing a silver halide photographic material according to claim 1, the pAg value having been maintained in the range of 6.5 to 7.5 for at least the first tenth of the total chemical sensitization time.

14. The method for producing a silver halide photographic material according to claim 13, the pAg value having been maintained in the range for at least the first half of the total chemical sensitization time.

15. The method for producing a silver halide photographic material according to claim 1, wherein the silver chlorobromide grains have a regular crystalline form, irregular crystalline form, or a composite thereof.

16. The method for producing a silver halide photographic material according to claim 15, wherein the grains have a regular crystalline form.

17. The method for producing a silver halide photographic material according to claim 1, said material having high contrast, high speed and suppressed fog.

18. The method for producing a silver halide photographic material according to claim 17, wherein the material is a color photographic material.

19. The method for producing a silver halide photographic material according to claim 1, wherein the pAg value ranges from 6.9 to 7.4.

* * * * *